US009131775B1

(12) United States Patent
Eisenberg

(10) Patent No.: US 9,131,775 B1
(45) Date of Patent: Sep. 15, 2015

(54) ADJUSTABLE SEATING

(71) Applicant: Joel H. Eisenberg, Paulden, AZ (US)

(72) Inventor: Joel H. Eisenberg, Paulden, AZ (US)

( * ) Notice: Subject to any disclaimer, the term of this patent is extended or adjusted under 35 U.S.C. 154(b) by 0 days.

(21) Appl. No.: 14/088,599

(22) Filed: Nov. 25, 2013

Related U.S. Application Data

(60) Provisional application No. 61/733,596, filed on Dec. 5, 2012.

(51) Int. Cl.
*A47C 7/14* (2006.01)

(52) U.S. Cl.
CPC ..... *A47C 7/14* (2013.01)

(58) Field of Classification Search
USPC ..... 297/341, 342, 343, 337, 317, 322
See application file for complete search history.

(56) References Cited

U.S. PATENT DOCUMENTS

| | | | | |
|---|---|---|---|---|
| 2,538,507 | A | 1/1951 | Cramer | |
| 2,725,921 | A | 12/1955 | Markin | |
| 3,489,459 | A | 1/1970 | Katan, Jr. et al. | |
| 3,756,654 | A * | 9/1973 | Bauer | 297/344.19 |
| 3,982,785 | A | 9/1976 | Ambasz | |
| 4,084,850 | A | 4/1978 | Ambasz | |
| 4,422,690 | A | 12/1983 | Kopich | |
| 4,452,486 | A * | 6/1984 | Zapf et al. | 297/343 |
| 4,491,366 | A | 1/1985 | Silber | |
| 4,761,033 | A | 8/1988 | Lanuzzi et al. | |
| 4,842,333 | A | 6/1989 | Meiller | |
| 5,035,466 | A | 7/1991 | Mathews et al. | |
| 5,150,948 | A * | 9/1992 | Volkle | 297/300.5 |
| 5,556,163 | A * | 9/1996 | Rogers et al. | 297/330 |
| 5,558,399 | A | 9/1996 | Serber | |
| 5,577,811 | A | 11/1996 | Ogg | |
| 5,580,127 | A | 12/1996 | Piretti | |
| 5,944,382 | A | 8/1999 | Ambasz | |
| 6,390,554 | B1 * | 5/2002 | Eakins et al. | 297/317 |
| 6,609,755 | B2 | 8/2003 | Koepke et al. | |
| 6,616,231 | B2 | 9/2003 | Koepke et al. | |
| 6,634,711 | B2 | 10/2003 | Phillips et al. | |
| 6,641,214 | B2 | 11/2003 | Veneruso | |
| 6,655,731 | B2 | 12/2003 | Martin | |
| 6,669,292 | B2 | 12/2003 | Koepke et al. | |
| 6,685,267 | B1 * | 2/2004 | Johnson et al. | 297/300.1 |
| 7,380,881 | B2 | 6/2008 | Freed et al. | |
| 7,475,943 | B1 | 1/2009 | Huang | |
| 7,611,202 | B2 * | 11/2009 | Johnson et al. | 297/343 |

(Continued)

FOREIGN PATENT DOCUMENTS

| | | |
|---|---|---|
| DE | 4239548 | 4/1993 |
| DE | 4239548 A1 | 4/1993 |

OTHER PUBLICATIONS

Office Action in corresponding U.S. Appl. No. 14/088,694, dated Aug. 28, 2014, pp. 1-9.

(Continued)

*Primary Examiner* — Sarah B McPartlin
(74) *Attorney, Agent, or Firm* — Fish & Richardson P.C.

(57) ABSTRACT

Among other things, a seat includes a base; a back-supporting surface coupled to the base; and a seating surface movable relative to the base in a direction of motion toward and away from the back-supporting surface. The back-supporting surface has a lower portion nearer the seating surface that is movable, relative to an upper portion of the back-supporting surface that is farther from the seating surface, in the direction of motion as the seating surface moves in the direction of motion.

100 Claims, 26 Drawing Sheets

(56) References Cited

U.S. PATENT DOCUMENTS

| | | | | |
|---|---|---|---|---|
| 8,061,775 | B2 | 11/2011 | Diffrient | |
| 8,347,791 | B1 * | 1/2013 | Gray et al. | 108/42 |
| 8,662,586 | B2 * | 3/2014 | Serber | 297/316 |
| 2008/0018155 | A1 * | 1/2008 | Smiley et al. | 297/341 |
| 2010/0231013 | A1 | 9/2010 | Schlenker | |
| 2011/0034839 | A1 * | 2/2011 | Yang et al. | 601/128 |
| 2012/0181838 | A1 * | 7/2012 | Wu | 297/423.2 |

OTHER PUBLICATIONS

Patent Application from corresponding U.S. Appl. No. 14/088,694, filed Nov. 25, 2013, pp. 1-53.

Transaction history from corresponding U.S. Appl. No. 14/088,694, downloaded Apr. 24, 2015, pp. 1-2.

Office Action in U.S. Appl. No. 14/088,694, dated Feb. 28, 2014, pp. 1-11.

Final Office Action in U.S. Appl. No. 14/088,694, dated May 30, 2014, pp. 1-8.

* cited by examiner

BACK GLIDE HINGED TO SEAT BACK

ADJUSTABLE SEATING

RELATED APPLICATIONS

This application is entitled to the benefit of the filing date of U.S. provisional application 61/733,596, filed on Dec. 5, 2012 and incorporated here by reference in its entirety.

TECHNICAL FIELD

The following description relates to adjustable seating.

BACKGROUND

A seat can support a user in a seated position to relieve physical stress associated with standing and to allow the user to engage in one or more sedentary activities for prolonged periods of time. Examples of such activities include working at a computer, reading, watching television, and driving an automobile.

Although sitting can alleviate physical stress associated with standing, the user's body can experience other types of physical stress in the seated position. Examples include stress on the user's back, hip, or neck. The amount of stress placed on parts of the user's body in the seated position can be a combination of the user's posture while in the seated position and the amount of time the user spends in the seated position, among other things. Prolonged periods of sitting can also result in circulatory problems that may cause injury to joints or other physical complications. In some circumstances, prolonged periods of sitting with inadequate support can result in injury to the user.

The immobilization of joints through prolonged periods of sitting can lead to chronic inflammation which may be linked to other diseases, such as heart disease, diabetes, Alzheimer's, stroke, and cancer.

SUMMARY

In general, in an aspect, a seat includes a base; a back-supporting surface coupled to the base; and a seating surface movable relative to the base in a direction of motion toward and away from the back-supporting surface. The back-supporting surface has a lower portion nearer the seating surface that is movable, relative to an upper portion of the back-supporting surface that is farther from the seating surface, in the direction of motion as the seating surface moves in the direction of motion.

Implementations may include one or more of the following features. The lower portion of the back-supporting surface is movable in the direction of motion in response to force exerted by a back of a user seated on the seating surface as the seating surface moves in the direction of motion. The lower portion of the back-supporting surface is movable in the direction of motion in response to force exerted by a back of a user seated on the seating surface as the seating surface remains stationary. The seating surface moves while the back supporting surface remains stationary. The lower portion of the back-supporting surface moves generally parallel to the direction of motion as the seating surface moves along an entire length of travel along the direction of motion. The lower portion of the back-supporting surface moves generally parallel to the direction of motion for a maximum distance of about 22.86 cm to 27.94 cm or, for a tall person 33 cm, as the seating surface moves along the direction of motion. The movement of the back-supporting surface relative to the seating surface changes the included angle between the seating surface and the back supporting surface as the seating surface moves in the direction of motion. A minimum included angle between the seating surface and the back-supporting surface is about 90 degrees to about 100 degrees. A maximum included angle between the seating surface and the back-supporting surface is about 140 degrees to about 160 degrees. The minimum included angle between the direction of motion and the back-supporting surface is between about 80 degrees and about 90 degrees and the maximum included angle is between about 140 degrees and about 160 degrees.

The seating surface is biased to move toward the back-supporting surface along the direction of motion. The seating surface is biased to move toward the back-supporting surface under the force of gravity. The back-supporting surface is rotatable about an axis parallel to the back-supporting surface and parallel to the seating surface. The axis of rotation of the back-supporting surface and the direction of motion of the seating surface are non-convergent. The back-supporting surface is movable in a direction perpendicular to the seating surface. The movement of the back-supporting surface in the direction perpendicular to the seating surface changes a distance between the lower portion of the back-supporting surface and the seating surface. The back-supporting surface is biased to move away from the seating surface in the direction perpendicular to the seating surface. A spring biases movement of the back-supporting surface away from the seating surface in the direction perpendicular to the seating surface. The axis of rotation of the back-supporting surface is between the lower and upper portions of the back-supporting surface. The direction of motion of the seating surface is, in some cases, oblique to the seating surface.-and in some cases substantially parallel to the seating surface. The direction of motion of the seating surface is inclined in a direction away from the back-supporting surface. The included angle between the seating surface and the direction of motion is constant as the seating surface moves along the direction of motion. The seating surface is slidably movable relative to the base. The seating surface is slidably movable relative to the base along the direction of motion. A spacer is disposed between the seating surface and the base and is fixed relative to the seating surface and slidably movable relative to the base. In some cases the seating surface is oblique to (or in some cases parallel to) the direction of motion and the spacer spans an included angle between the direction of motion and the seating surface. The back-supporting surface is slidably movable relative to the base.

The base sometimes includes a plurality of wheels to move the seat on the floor. The base is adjustable in a direction relative to the floor. The base includes a gas cylinder actuatable to move the base relative to a floor. In some cases, the back support can include at least one roller in contact with a back of a user seated on the seating surface and rotatable relative to the back of the user as the seating surface moves in the direction of motion. A mechanism slows or stops motion of the seating surface at one or more positions along its direction of motion. A mechanism slows or stops motion of the back supporting surface. A mechanism permits adjusting an arc of rotation of a lower portion of the back supporting surface. The mechanism comprises a detent. A device controls a path of the motion of the back supporting surface. A device controls the motion of the seating surface. A mechanism enables vertical adjustment of a position of the back supporting surface relative to the seating surface. A mechanism enables the back supporting surface to be adjusted horizontally relative to the seating surface. A mechanism permits adjusting a vertical height of the back supporting surface above the floor. The seating surface may be parallel to the direction of motion of the seating surface. The seat can include arms, storage areas, a foot stool, or a work surface.

In general, in an aspect, a seat includes a base; a back-supporting surface coupled to the base; and a seating surface movable relative to the base in a direction of motion toward and away from the back-supporting surface. The back-supporting surface and the seating surface are independently movable relative to one another, and the back-supporting surface is movable to push the user away from the back-supporting surface or to push the seat away from the back-supporting surface or both, along the direction of motion.

Implementations may include one or more of the following features. The back-supporting surface is movable in response to a force exerted on the back-supporting surface by the user. In some instances, the back-supporting surface can be movable in response to motorized force exerted on the back-supporting surface. The seat glide is movable in response to a motorized force exerted on the seat glide or to another external force other than the user. The back-supporting surface is movable in response to manual methods exerted on the back-supporting surface. A stopping mechanism limits a range of motion of the seat glide as it moves back and forth.

The back-supporting surface is movable in a direction substantially perpendicular to the seating surface. The back-supporting surface includes a lower portion nearer the seating surface and an upper portion that is farther from the seating surface, and the back-supporting surface is rotatable about an axis between the upper and lower portions of the back-supporting surface and substantially parallel to the seating surface. The axis is movable in a direction perpendicular to the seating surface to change a point of contact between a back of the user and the lower portion of the back-supporting surface. The height of the back-supporting surface relative to the seating surface is adjustable. The seating surface is slidably mounted on a seat guide that is fixed on the base and the horizontal distance of the surface of the seat back from the seat guide is adjustable.

In general, in an aspect, a user is supported above a floor in a way that includes: moving a seating surface in a direction of motion toward and away from a back-supporting surface; and varying an orientation of the back-supporting surface such that a portion of the back-supporting surface closest to the seating surface moves generally parallel to the direction of motion as the seating surface moves along the direction of motion.

Implementations may include one or more of the following features. The varying of the orientation of the back-supporting surface is based at least in part on a force exerted by a back of a user seated on the seating surface as the seating surface moves in the direction of motion. The varying of the orientation of the back-supporting surface is based at least in part on a force exerted by a back of a user seated on the seating surface when the seat is not gliding. The varying of the orientation of the back-supporting surface includes changing the included angle between the seating surface and the back-supporting surface. The changing of the included angle between the seating surface and the back-supporting surface includes rotating the back-supporting surface about an axis parallel to the back-supporting surface and parallel to the seating surface. Changing the included angle between the seating surface and the back-supporting surface sometimes comprises the seating surface moving in the direction of motion. The varying of the orientation of the back-supporting surface includes continuously varying the orientation of the back-supporting surface as the seating surface moves along the direction of motion. The varying of the orientation of the back-supporting surface includes changing a distance, parallel to the direction of motion, between the seating surface and the portion of the back-supporting surface closest to the seating surface. The arc of rotation of the seat back is adjustably controllable. The degree of rotation can be limited by a detent.

In certain implementations, the seat has arms. The arms can be attached to the seat glide, the back support, the seat guide, the back supporting surface, or the base. The arms can have storage areas. A foldable foot stool, for example, stored in the arms, can extend out for use in connection with an ample degree of re-anticline, A desk top can extend transversely over the user.

Implementations can include one or more of the following advantages.

In some implementations, seats include a back-supporting surface having a lower portion that is movable, relative to an upper portion of the back-supporting surface, in a direction of motion as a seating surface moves in the direction of motion toward and away from the back-supporting surface. Such movement of the back-supporting surface can facilitate consistent support of a user's back as the user moves the seat through various seating positions. For example, a point on the lower portion of the back-supporting surface can remain in contact with a point on a lumbar portion of the user's back through various seating positions to reduce the likelihood of stress and/or injury caused by inappropriate or inconsistent lumbar support. It also can push into the spine resulting in an articulation (gentle manipulation) of the spine.

In certain implementations, the lower portion of the back-supporting surface is movable in the direction of motion in response to force exerted by a back of a user seated on the seating surface as the seating surface moves in the direction of motion. Such movement of the back-supporting surface in response to force exerted by a back of a user can facilitate adjustment of the seating position of the user without taking the user's hands away from another activity (e.g., typing on a computer, holding a telephone, etc.). Additionally or alternatively, such movement of the back-supporting surface in response to force exerted by a back of a user can facilitate continuous (or substantially continuous) minor adjustments to the seated position of the user and can cause spinal adjustments.

In some implementations, the lower portion of the back-supporting surface and the seating surface are independently movable relative to one another in the direction of motion. Such relative independent movement of the back-supporting surface and the seating surface can allow a user to exert a force on the back-supporting surface such that a lower portion of the back supporting surface moves the user's lumbar spine forward and, in some instances, up an incline plane to rotate the user's pelvis, mobilizing the user's spine while the user is in the seated position. It is believed that such mobilization of the user's spine produces joint motion necessary for intervertebral joint cartilage nourishment which might otherwise degenerate and result in a cascade of events producing chronic inflammation, as compared to sitting in a stationary position in which the user's spine is immobilized.

In some implementations, the seating surface is biased (e.g., under the force of gravity) to move toward the back-supporting surface along the direction of motion. As compared to an unbiased seat, this bias can improve circulation to a user's joints. For example, while in the seated position, one or more of the user's knees, hips, and lower back can be actively engaged to resist the movement of the seating surface toward the back-supporting surface. And it can move spinal joints.

In certain implementations, the lower portion of the back-supporting surface moves in the direction of motion through a combination of vertical movement (e.g., movement in a direction perpendicular to the seating surface) and rotational movement (e.g., a change in the included angle between the back-supporting surface and the seating surface). These combined movements can facilitate consistent support of the user's back through a range of seating positions, which may be required for performing a particular task. For example, the relative movement of the back-supporting surface to the seating surface can be substantially self-adjusting in response to movement of the user. Additionally or alternatively, the relative movements of the back-supporting surface and the seating surface can be implemented through a robust mechanical design (e.g., a spring biasing the back-supporting surface away from the seating surface and an incline biasing the seating surface toward the back-supporting surface) suitable for numerous, continuous adjustments over prolonged periods e or use of a spring assisting the seating surface away from the back supporting surface especially in the case of a severe incline.

In some implementations, the height of the axis of the rotational movement (e.g., the height of a hinge) of the back-supporting surface can be adjusted relative to the seating surface to mobilize different parts of the user's spine. For example, positioning the axis of rotation of the back-supporting surface at a point high on the user's back will result in less rotation of the back-supporting surface and more forward motion of the seating surface as the user pushes back on the back-supporting surface while in the seated position. Similarly, positioning the axis of rotation of the back-supporting surface at a point low on the user's back will result in more rotation of the back-supporting surface and less forward motion of the seating surface as the user pushes back on the back-supporting surface while in the seated position. Thus, in some instances, the axis of rotation of the back-supporting surface can be changed (e.g., by user manipulation or through motorized movement) to mobilize different parts of the spine.

In general, in an aspect, a seat includes a base, a back-supporting surface coupled to the base, and a seating surface movable relative to the base in a direction of motion toward and away from the back-supporting surface. The back supporting surface is supported by a mechanism that enables up and down motion of the back supporting surface relative to the base independently of the motion of the seating surface toward and away from the back-supporting surface.

Implementations may include one or more of the following features. The supporting mechanism is biased to move the back-supporting surface up to a rest position when no force is being applied to move the back-supporting surface down. The supporting mechanism provides a resting vertical position for the back-supporting surface, and the resting vertical position can be adjusted up and down manually.

In general, in an aspect, a seat includes a base, a back-supporting surface coupled to the base, and a seating surface movable relative to the base in a direction of motion toward and away from the back-supporting surface. The back supporting surface is supported by a mechanism that, while the seating surface moves toward and away from the back-supporting surface, simultaneously enables up and down motion of the back supporting surface relative to the base, and rotation of the back-supporting surface about an axis.

Implementations may include one or more of the following features. The axis of the back-supporting surface is horizontal and is perpendicular to and higher than the seating surface. When the seat is not occupied, the back supporting surface is biased to rise to a rest position vertically and to rotate to an upright resting orientation.

In general, in an aspect, a seat includes a base, a back-supporting surface coupled to the base, and a seating surface movable relative to the base in a direction of motion toward and away from the back-supporting surface. A mechanism that has a manual control enables a user to selectively reduce the ability of the seating surface to move toward and away from the back-supporting surface at two or more locations along the direction of motion of the seating surface. The same manual control also enables the user to control a height of the seat above a floor. The manual control comprises a lever that is reachable at a periphery of and below the seat. The manual control can be moved in one direction to control the height of the seat through a gas cylinder and in a second direction to selectively reduce the ability of the seating surface to move toward or away from the back supporting surface.

In general, in an aspect, a seat includes a base, a back-supporting surface coupled to the base, and a seating surface movable relative to the base in a direction of motion toward and away from the back-supporting surface. The back supporting surface is supported by a mechanism that enables rotation of the back-supporting surface about an axis that is horizontal and is perpendicular to and above the direction of motion. The back-supporting surface has a center of gravity above the axis of rotation. A rotation control mechanism reduces the tendency of the back supporting to rotate back beyond a predetermined angle of rotation. The back supporting surface is mounted so that it's its center of gravity is forward of the axis of rotation so that when the seat is not occupied, the back supporting surface tends to rotate to an upright position.

Implementations may include one or more the following features. The rotation control mechanism comprises a detent. A mechanism stops the rotation of the back supporting surface at the upright position when it tends to rotate to the upright position.

The details of one or more implementations of the invention are set forth in the accompanying drawings and the description below.

Other features, objects, and advantages of the invention will be apparent from the description and drawings, and from the claims.

DETAILED DESCRIPTION

Figure 1:
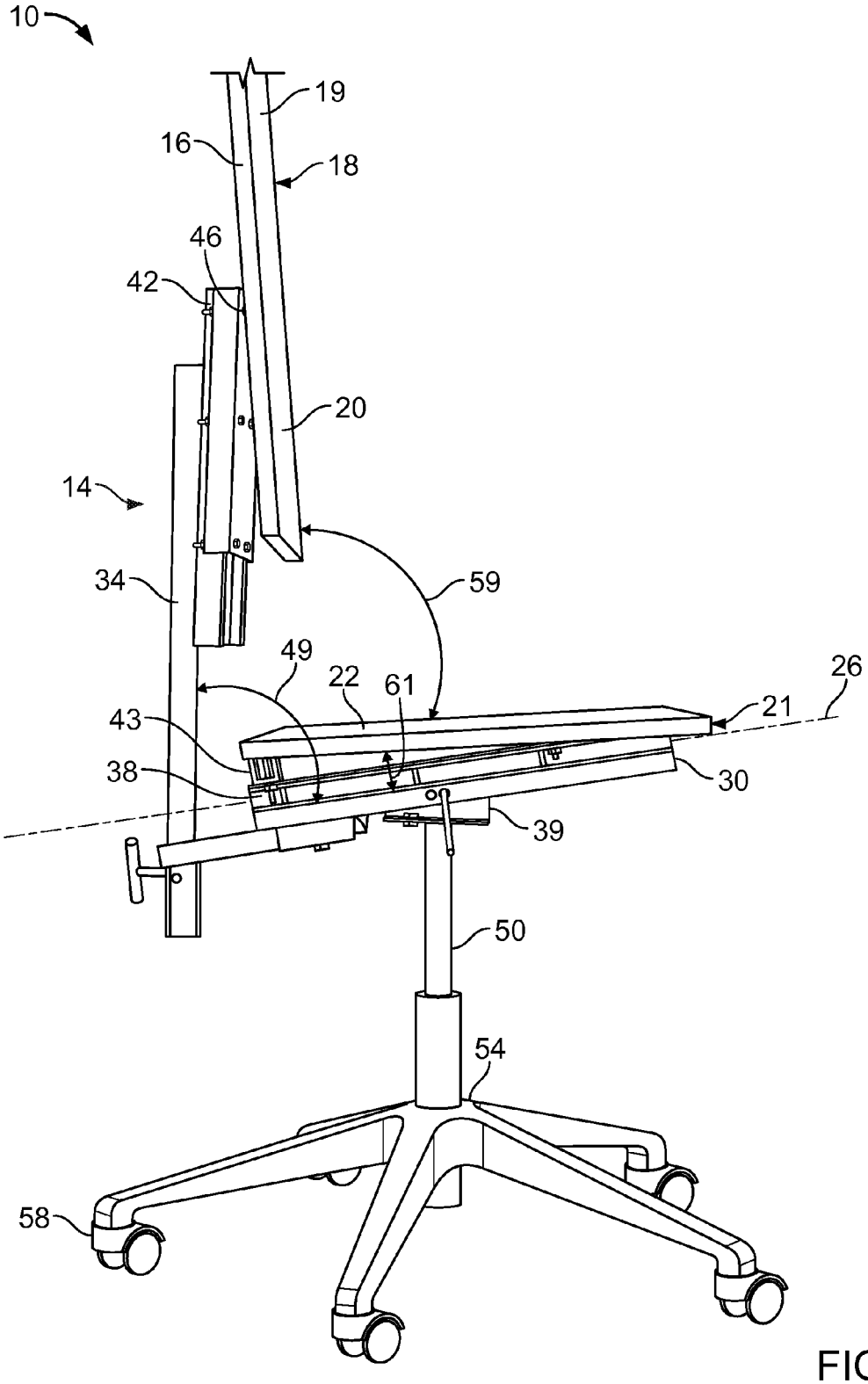
FIG. 1 is a side view of a seat in a first position.
Figure 2:
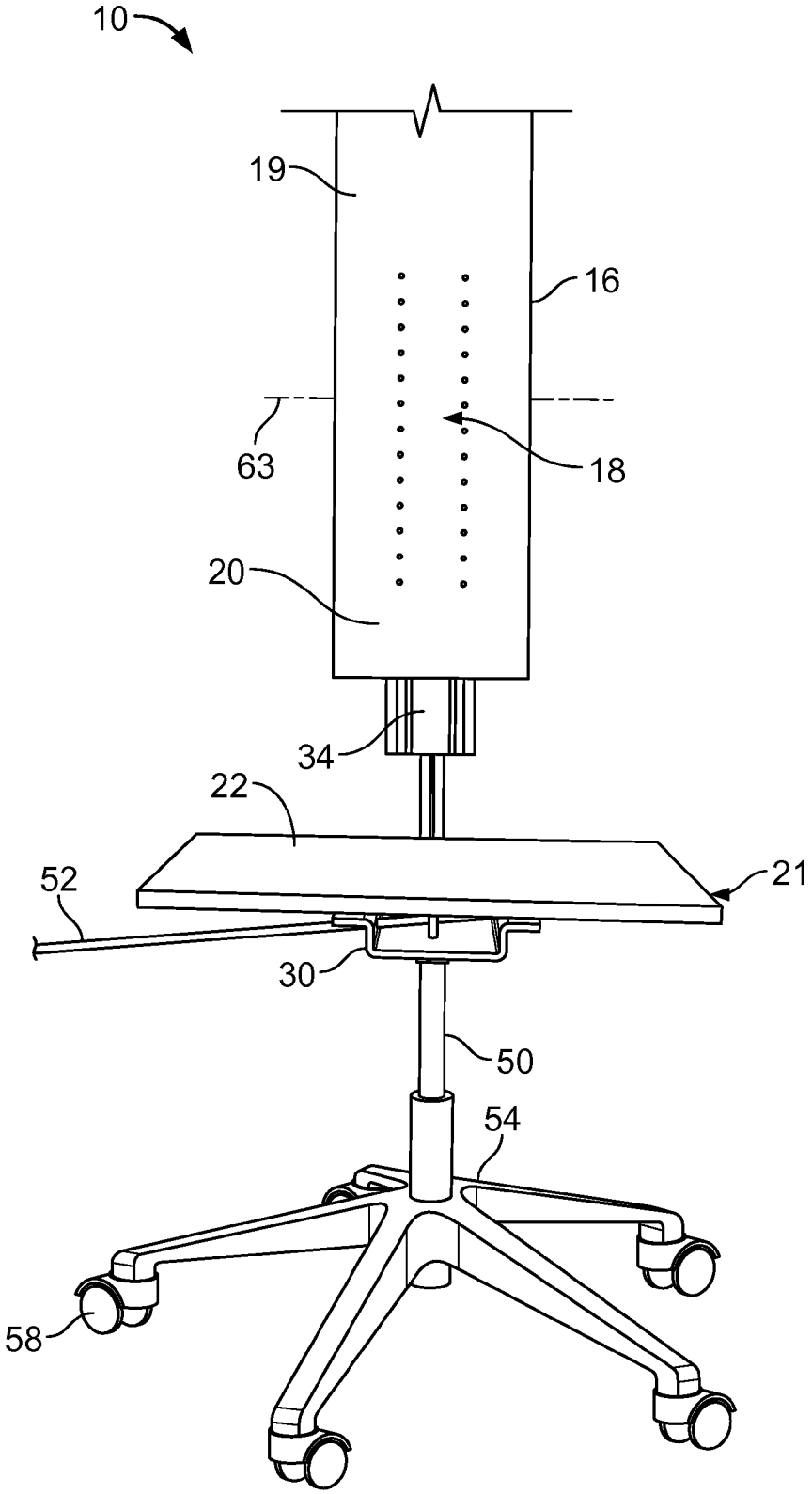
FIG. 2 is a front view of the seat of FIG. 1 in the first position.
Figure 3:
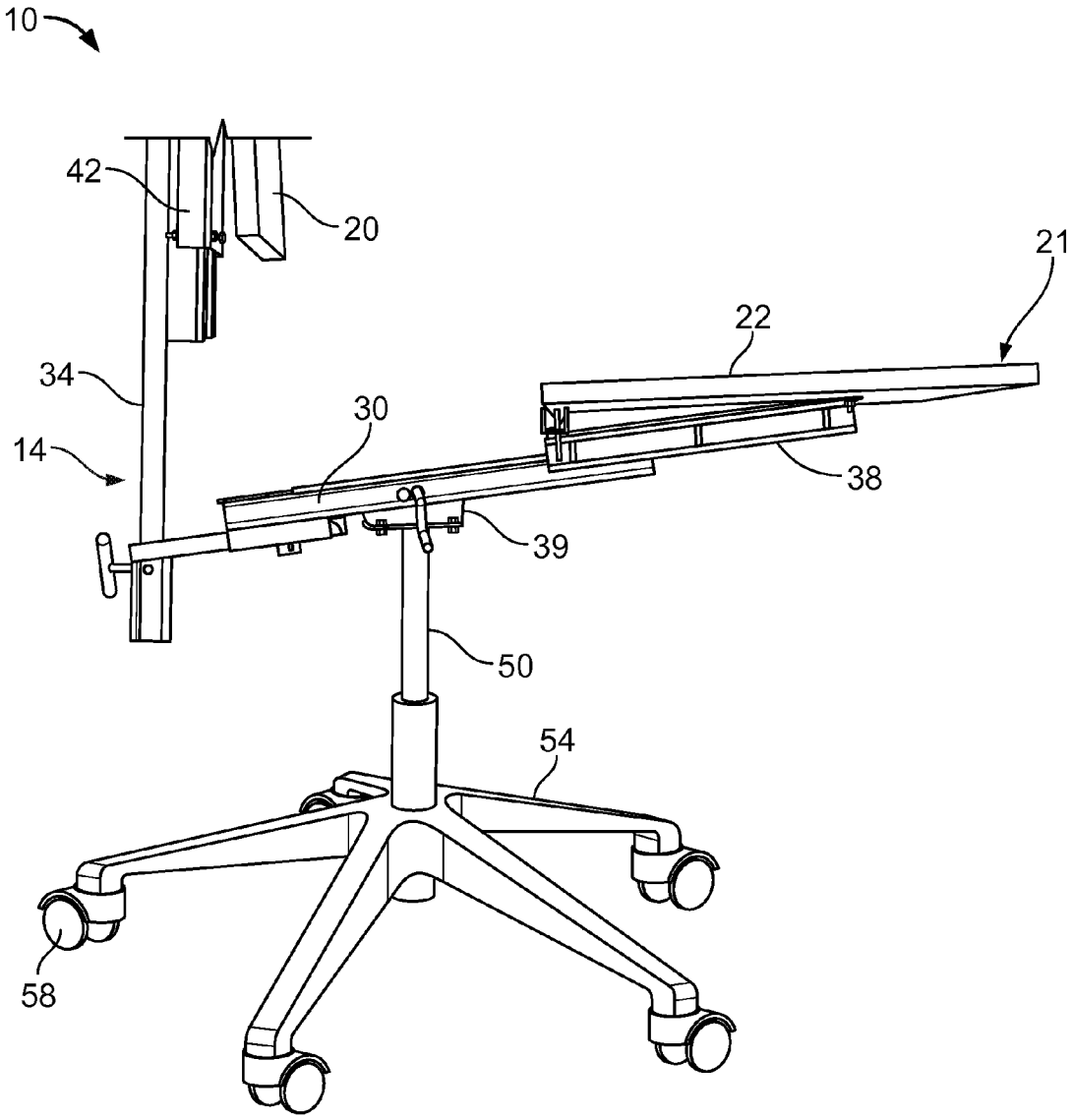
FIG. 3 is a side view of the seat of FIG. 1 in a second position.
Figure 4:
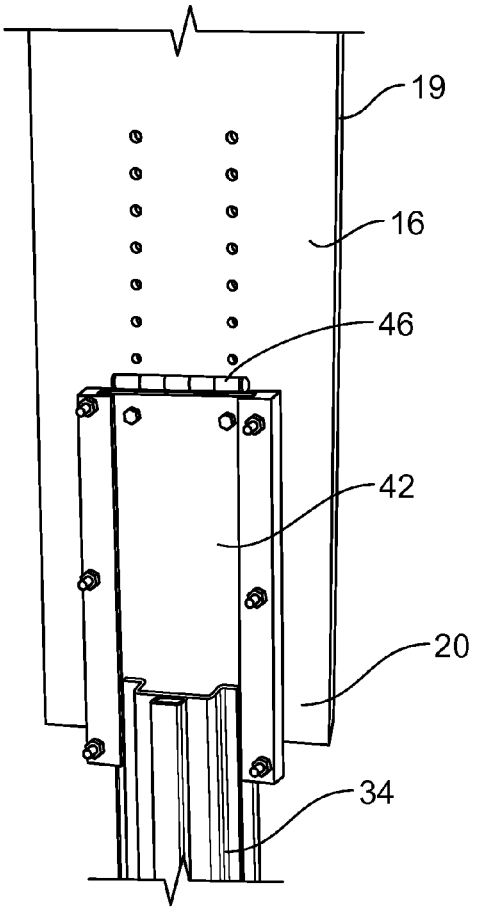
FIG. 4 is a partial rear view of the seat of FIG. 1.

Referring to FIGS. 1 through 11, a seat 10 includes a base 14, a back support 16, and a seat pan 21. As described in further detail below, the back support 16 and the seat pan 21 are each coupled to the base 14 by mechanisms that allow each of them to move relative to the base and relative to each other. The coupling mechanisms are arranged such that user-exerted force on the back support 16 and the seat pan can cause (1) movement of the seat pan 21 back and forth along a direction of motion 26 and (2) changes of the angle, height, and position of the back support 16 relative to the seat pan 21 through a range of seating positions.

As compared to passively sitting on a non-adjustable seat, the movements and relative movements of the back support 16 and the seat pan 21 allowed by the coupling mechanisms can reduce the likelihood of injury to the user who is in a seated position over prolonged periods. Injury can be reduced by, for example, enhancing blood flow to the user's joints or facilitating strengthening of certain anatomical core muscles (e.g., abdominal muscles, oblique muscles, erector spinae, or a combination of any two or more of them) or allowing the articular surface of intervertebral joints to be bathed by synovial fluid which nourishes the cartilage surface, or a combination of any two of more of these benefits.

In the FIGs, the seat 10 has been shown without cushions or contoured surfaces. However, one or more of the surfaces supporting the weight of the user can include a cushion or a contoured surface or a combination of them to improve comfort for the user.

The base 14 includes a seat guide 30 and a back guide 34. The back guide 34 is substantially vertical relative to a horizontal floor surface. The seat guide 30 inclines relative to the horizontal floor surface with the rear end of the seat guide closer to the floor than its front end such that the seat guide 30 defines an inclined direction of motion 26. During use, the included angle 49 between the seat guide 30 and the back guide 34 is typically fixed while the mechanisms that couple the seat pan and the back support to the seat guide and the back guide permit the seat pan and back support to move. As a result, forces (for example forces imparted by the user) on the seat pan and the back support are free to produce movement of the back support 16 and the seat pan 21 relative to the base and relative to one another.

The angle 49 between the back guide and the seat guide (for example, 80-90 degrees) will be uncomfortable to many people and in some cases they will tend to lean back on the back support to cause it to pivot about 10 degrees relative to the back guide so that the effective included angle 59 between the back support and the seat pan is about 90 degrees.

Figure 15:
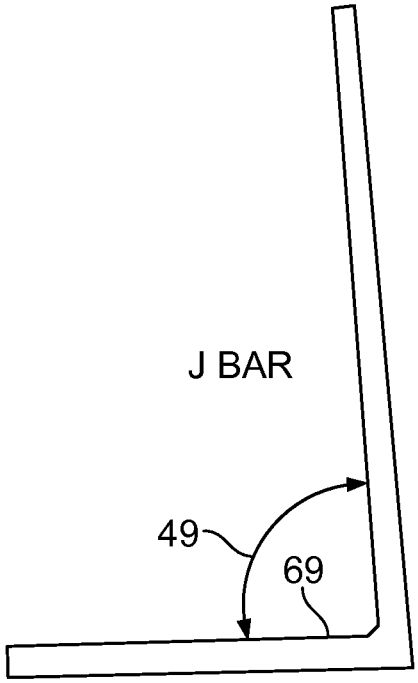
FIGS. 15, 16, 16A, 17, 18, 19, 20, 21, 22, and 23 show pieces of and the assembling of the pieces of the back of a seat.
Figure 16:
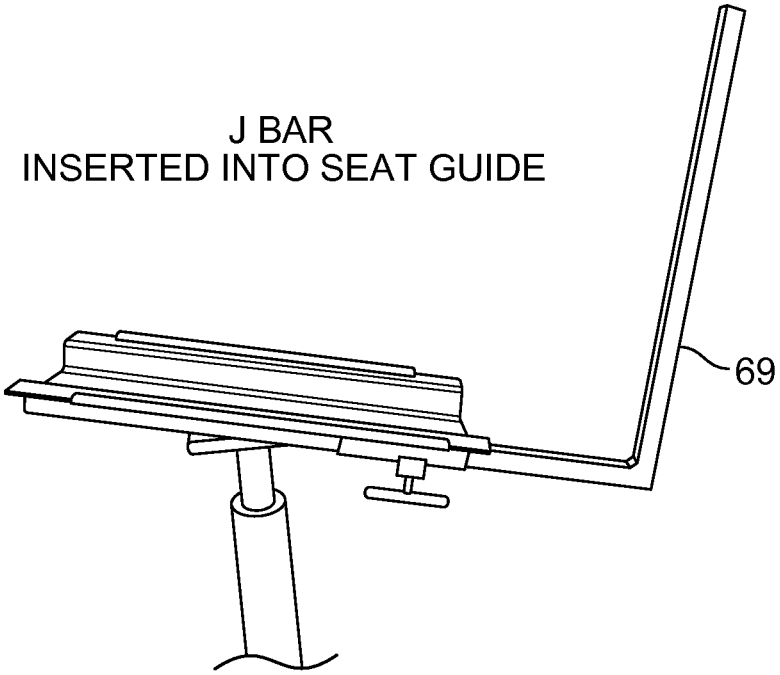
Figure 16A:
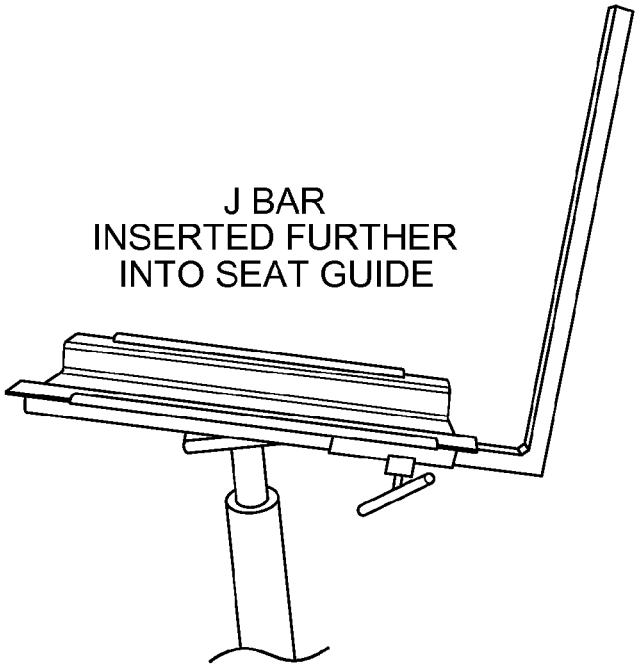

In some implementations, the angle 49 can be defined by an angle between a back piece and a seat piece of what we sometimes refer to as a J bar. As shown also in FIG. 15, the J bar 69in some examples can be simply two square-cross-section pipes welded together to form a rigid piece with the angle 49 between them. The seat piece of the J bar can be inserted into and clamped to the seat guide as shown in FIG. 16. As shown in FIG. 16A, the seat piece can be inserted to different degrees into the seat guide.

Figure 17:
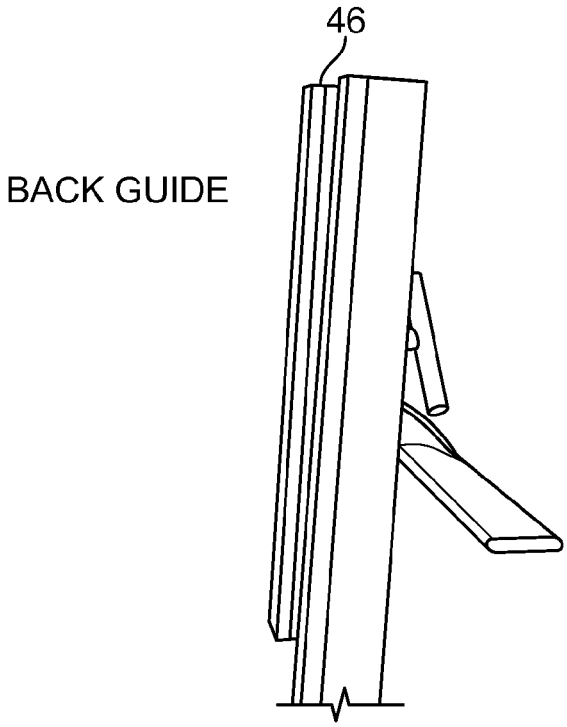
Figure 18:
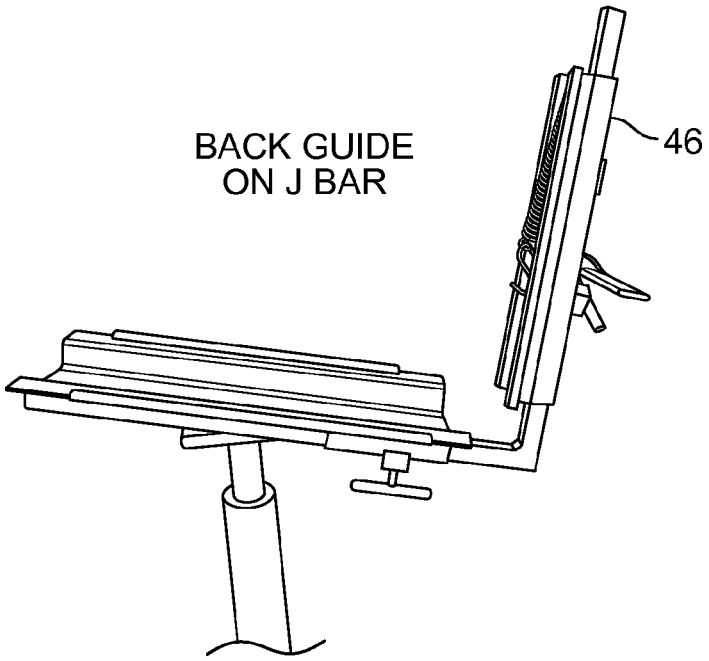

In some examples, the back guide 46 is slid onto the J bar and is adjustable up and down on the J bar as shown in FIGS. 17 and 18. As mentioned, the J bar can be at a fixed angle 49, different J bars can have different fixed angles, or the J bar can have an adjustable angle. It seems comfortable for most people to have the back piece of the J bar at 90° to the seat guide and therefore at about 100° to the floor (leaning back about 10°).

Figure 19:
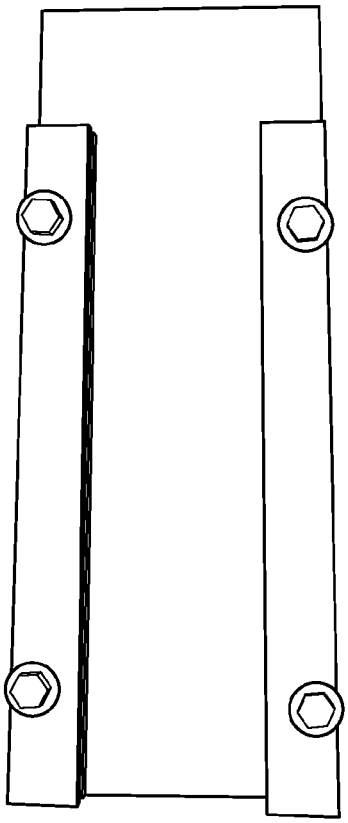
Figure 20:
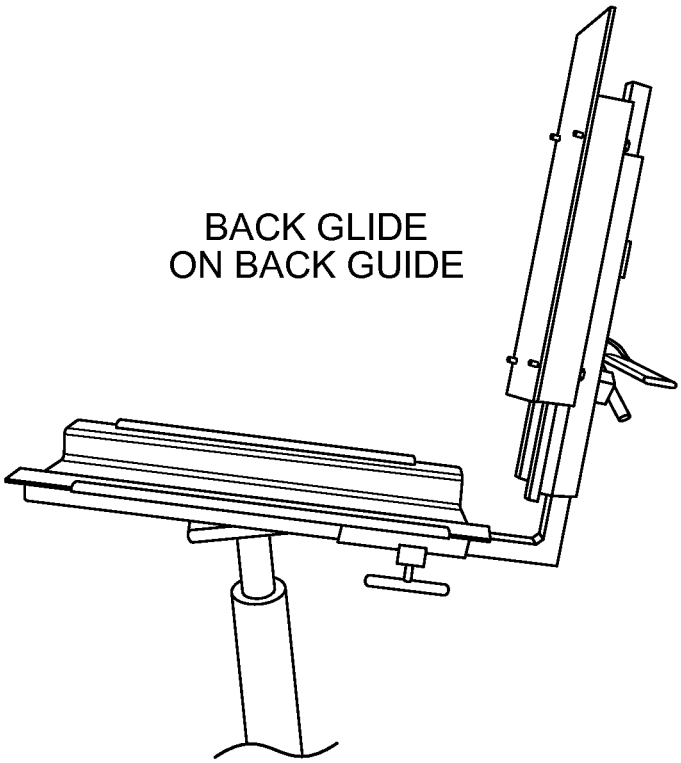
Figure 21:
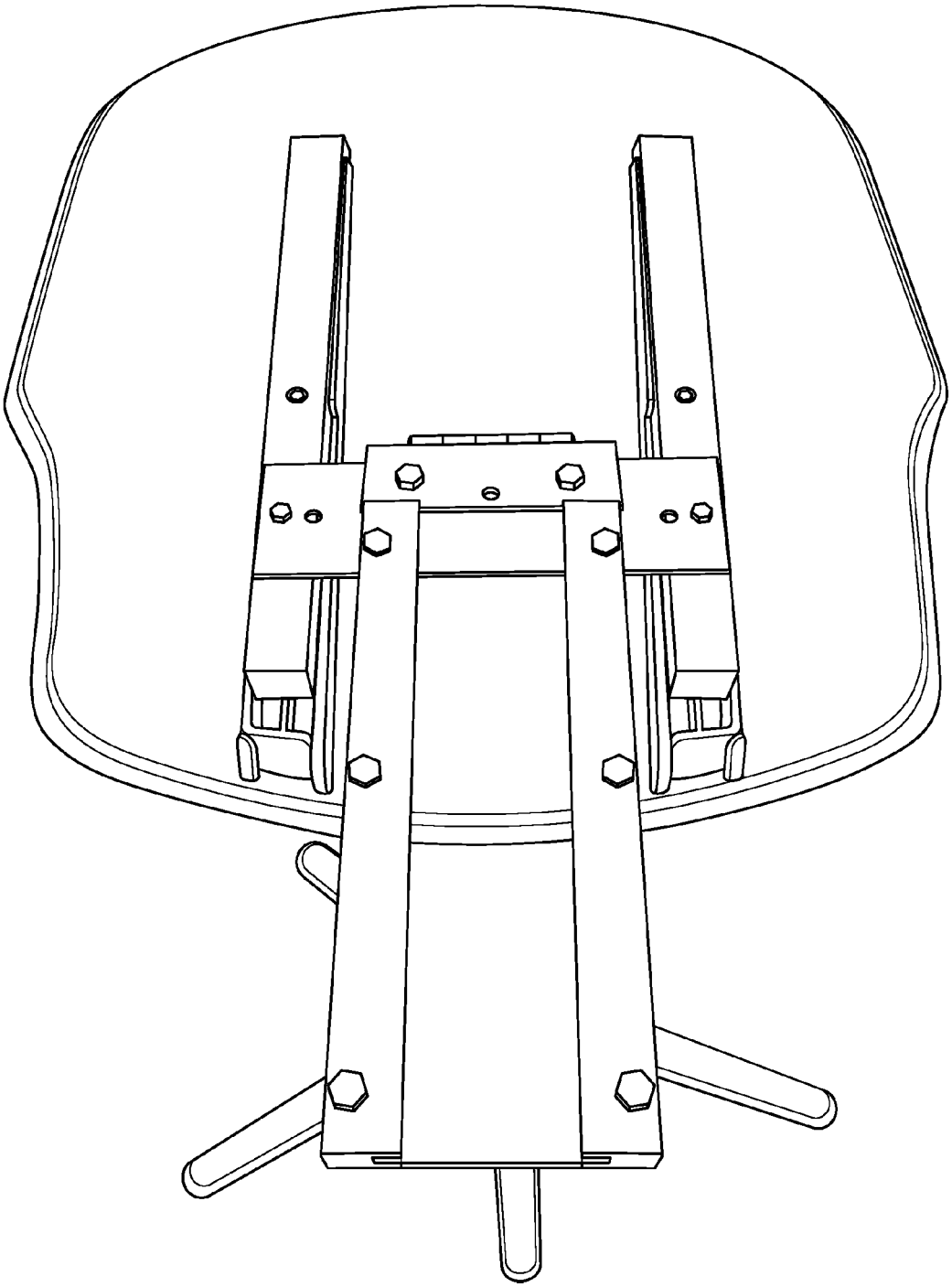
Figure 22:
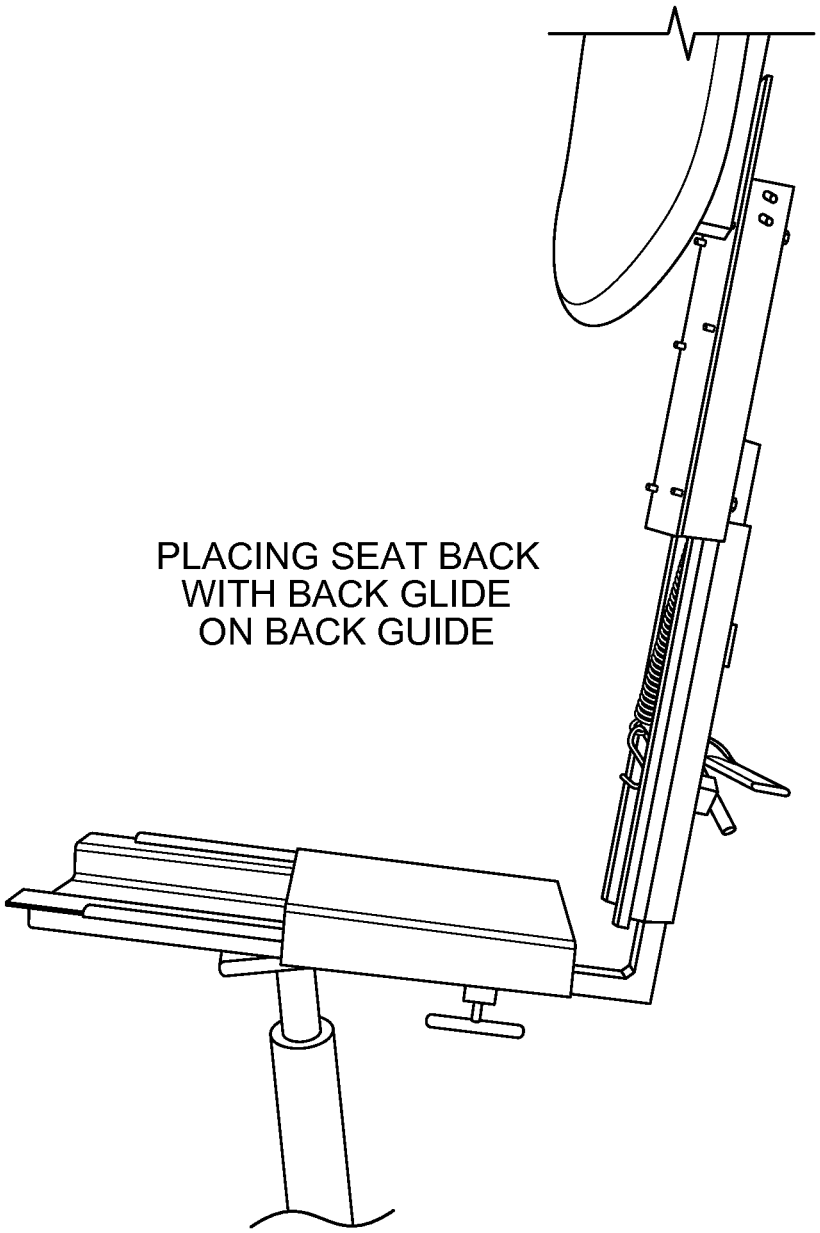
Figure 23:
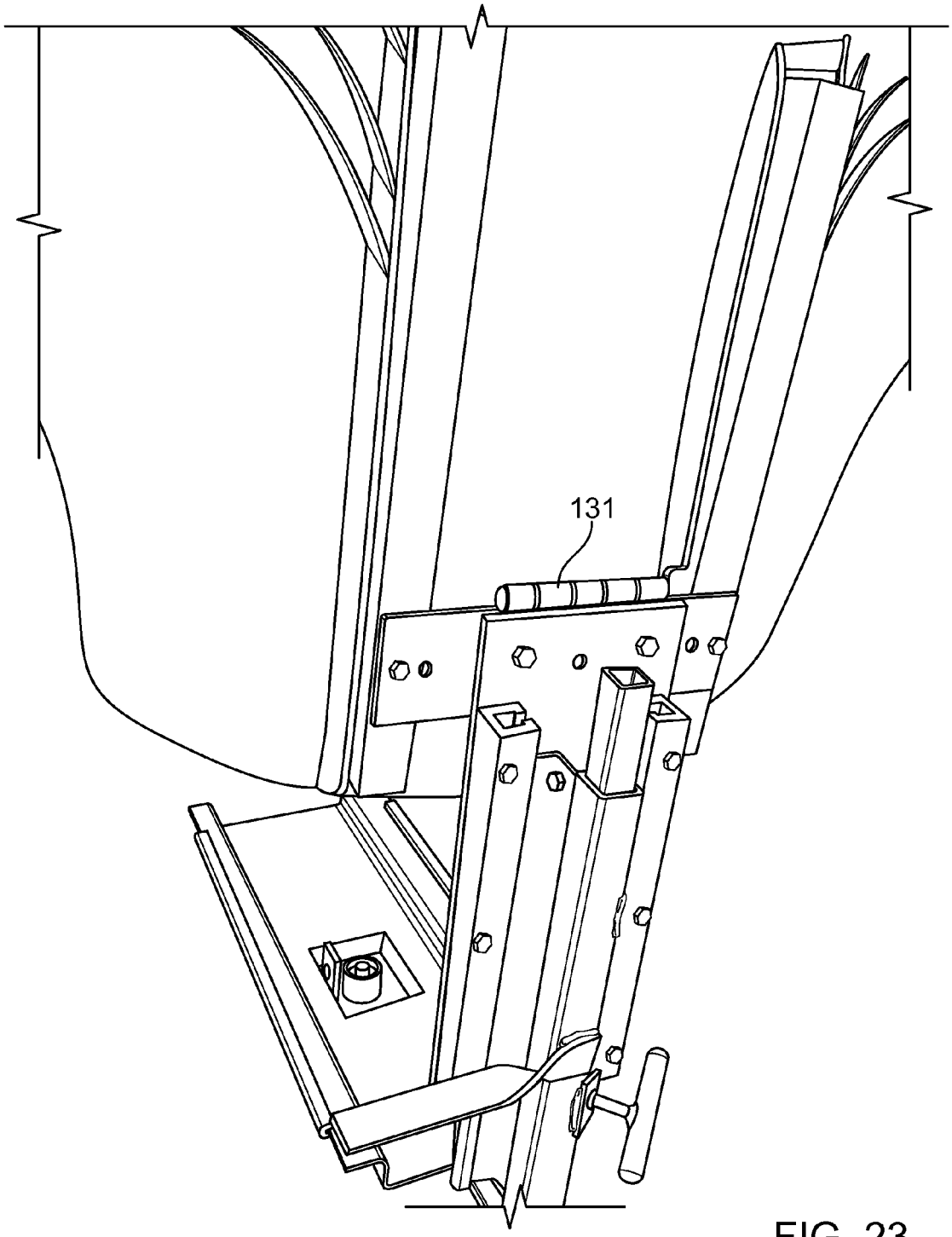

FIG. 19 shows the back glide detached from the seat. The hinge that provides the axis of rotation is mounted on the top of the back glide and attached to the seat back. FIG. 20 shows the back glide on the back guide. FIG. 21 shows the back glide hinged to the seat back. FIG. 22 shows the chair back with attached back glider being placed on the back guide that is on a J bar. FIG. 23 shows the seat back attached to the back glider that has been slid onto the back guide that has been slid onto the J bar which has been slid into the seat guide. The back guide is adjustable up and down on the J bar. The J bar is adjustable in and out of the seat guide.

A seat glider 38 that is fixed relative to (for example, is attached to the bottom of) the seat pan 21 can rest on or be connected to the seat guide 30 to permit the seat pan to move slidably back and forth along the seat guide. Stops can be provided, for example, in the vicinity of the front and the back of the seating surface to limit the range of the seat glide as it moves back and forth. The stops prevent the seat glide from falling off and for a person who is obese or has long thighs. The back seat glide stop can be adjusted forward to yield the same effect as if there were a longer seat pan by providing more seat pan under the distal thigh (near the knee).

The motion can be along channels defined by the seat glider 38 or along ball bearings held by the seat glider 38 or vice versa or by a variety of other mechanisms. The seat pan 21 moves along the direction of motion 26 as the seat glider 38 moves relative to the seat guide 30 along the direction of motion 26. The seat pan 21 has a seating surface 22 substantially parallel to a horizontal floor to support a user during use. The seat pan 21 and, thus, the seating surface 22 can move along the direction of motion 26 in response to force exerted by the user seated on the seating surface 22 (e.g., in a direction away from or toward the back support 16) or under the force of gravity (e.g., in a direction toward the back support 16) because of the incline of the seat guide, or a combination of both.

In some cases, the seating surface 22 and the direction of motion 26 defined by the seat glider) 38 may be oblique to one another by an angle 61, with the seating surface 22 substantially parallel to a horizontal floor and the direction of motion 26 inclined relative to the horizontal floor during use. In some cases the seating surface and the direction of motion need not be oblique to one another. The seating surface 22 is usually substantially parallel to a horizontal floor during use to provide a comfortable support to the user. The included angle 61 between the seating surface 22 and the direction of motion 26 is constant as the seating surface 22 moves along the direction of motion 26, toward and away from the back-supporting surface 18.

The seat glider 38 is inclined relative to the horizontal floor during use which allows gravity to provide a small force tending to move the seating surface 22 in a direction toward the back support 16 and, additionally or alternatively, to position the direction of motion 26 along a path that can be followed by a lower portion of the back support 16 as the back support 16 and the seat pan 21 move relative to one another (e.g., under force exerted by the user).

A spacer 43 can be disposed in the included angle between the seat pan 21 and the seat glider 38 to support at least a portion of the weight of the user seated on the seating surface 22. For example, the spacer 43 can be disposed beneath the portion of the seat pan 21 closest to the back support 16. In certain implementations, the spacer 43 can be integrally formed with the seat glider 38 and the seat pan 21.

The back support 16 is coupled to a back glider 42 by a hinge 46 disposed between an upper portion 19 and a lower portion 20 of the back supporting surface of the back support 16. The hinge 46 defines a horizontal axis of rotation substantially parallel to the back supporting surface 18 and substantially parallel to the seating surface 22. The axis of rotation 63 (FIG. 2) defined by the hinge 46 is non-convergent with the direction of motion 26 (e.g., the hinge 46 lies above the direction of motion 26). Rotation of the upper portion 19 and the lower portion 20 of the back support 16 about the hinge 46 can change the respective positions of the upper portion 19 and the lower portion 20 of the back supporting surface 18 relative to the back guide 34.

In addition, the back glider 42 is slidably movable relative to the back guide 34 in a substantially vertical direction 27 (e.g., along channels defined by the back glider 42 or along ball bearings held by the back glider 42 or by another mechanism). The vertical motion can occur at the same time as the back supporting surface 18 rotates about the rotational axis 63 defined by the hinge 46 and as the seat glider is moving back and forth along the direction 26. A mechanism is provided to apply an upward force to bias the back glider toward a top position of its vertical motion. In use, downward forces may be applied to cause the back glider to move downward. When those forces are released, the upward biasing force tends to return the back glider to its top position.

Figure 5:
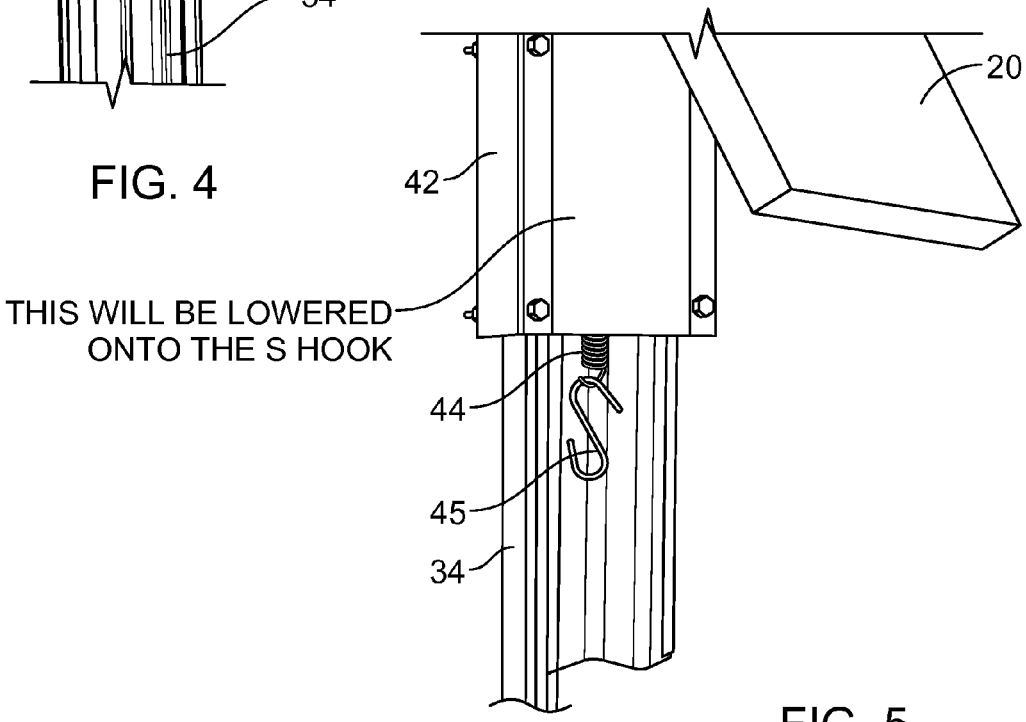
FIG. 5 is a partial perspective view of a back guide and a back glider of the seat of FIG. 1.
Figure 6:
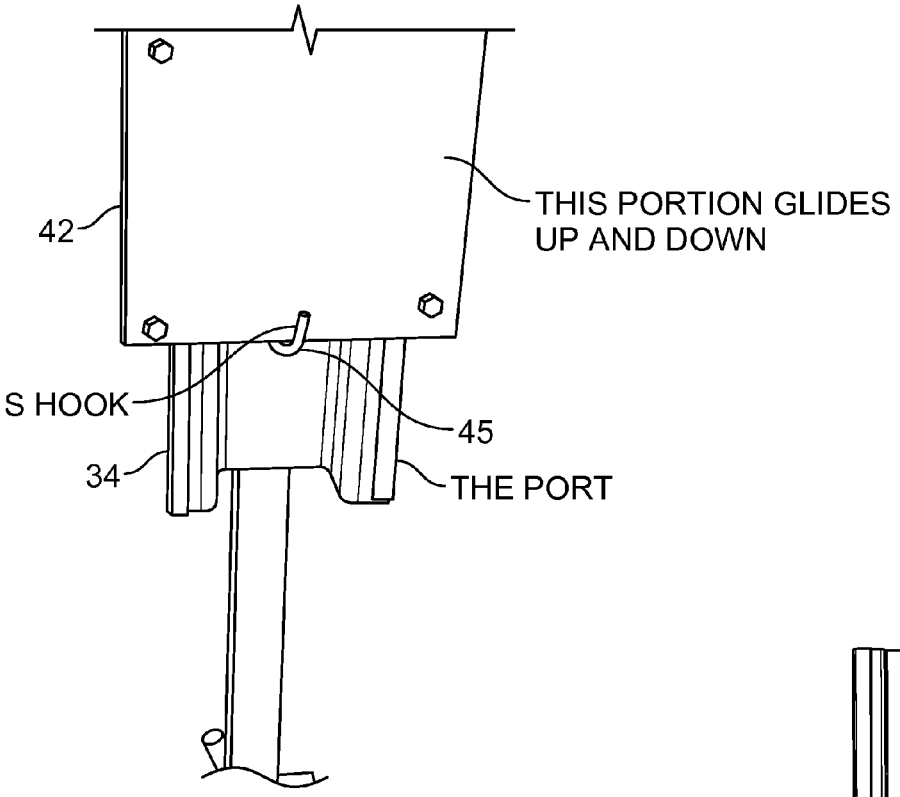
FIG. 6 is a partial front view of the back guide and the back glider of the seat of FIG. 1.
Figure 7:
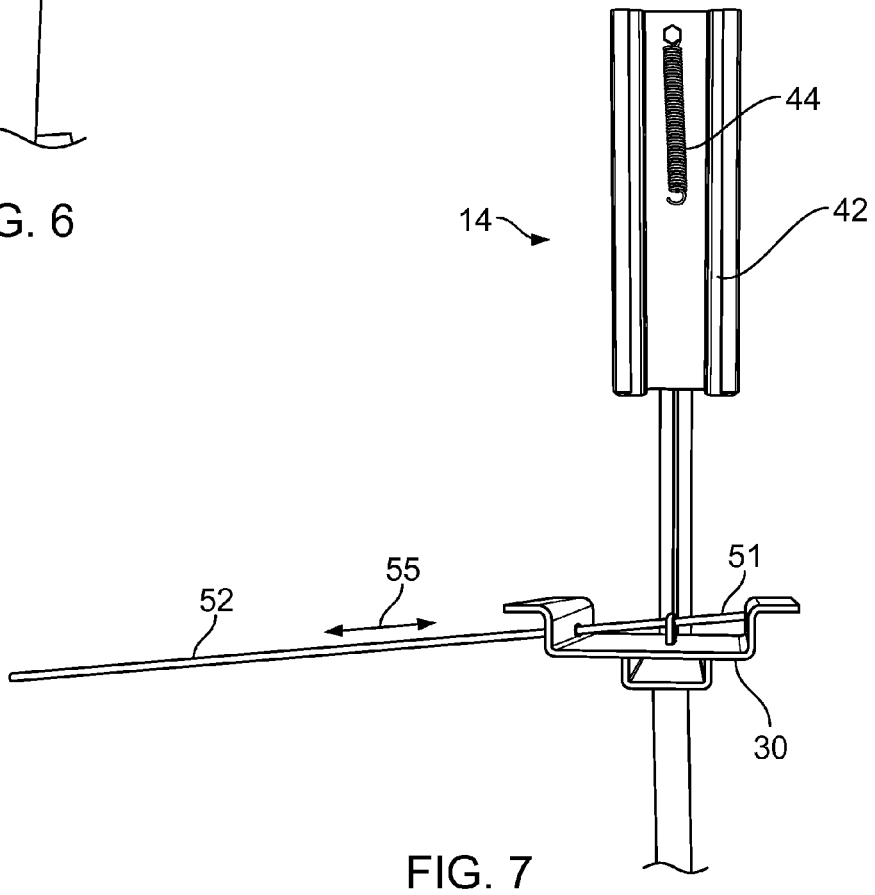
FIG. 7 is a partial front view of a base of the seat of FIG. 1.
Figure 8:
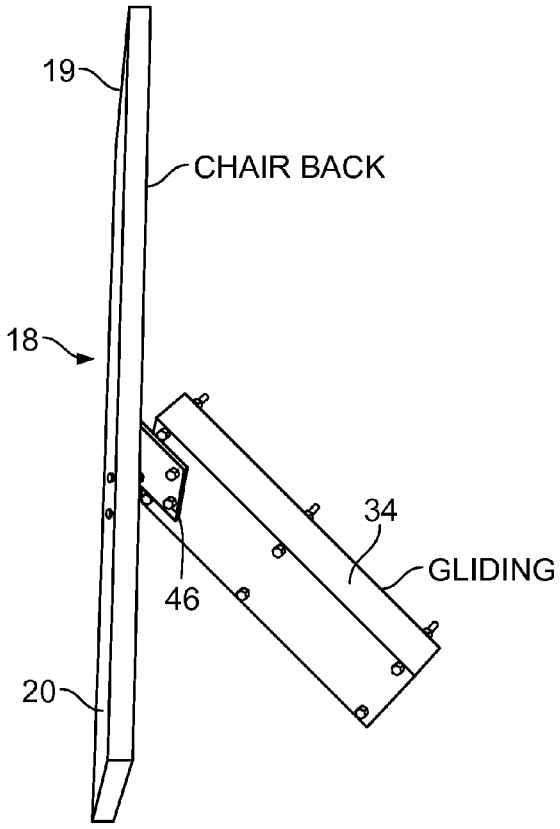
FIG. 8 is a perspective view of a back support and a back glider of the seat of FIG. 1.
Figure 9:
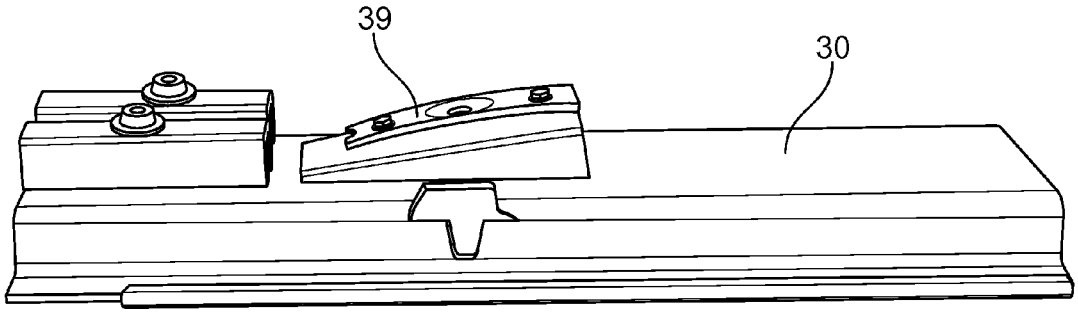
FIG. 9 is a perspective view of a seat guide of the seat of FIG. 1.

In some examples, as shown in the FIGS. 5 and 6, a hook 45 is coupled to the back glider 42 and to one end of a spring 44 (e.g., a compression spring or a gas spring or an extension spring) that applies the upward biasing force. Other supporting devices rather than a hook can be used to support the back glider on the spring. Another end of the spring 44 is coupled to the back guide 34 such that movement of the back glider 42 downward along the vertical direction 27 creates tension in the spring 44. The upward biasing force of the spring 44, in response to the tension, can return the back glider 42 to an original position (e.g., a position corresponding to the equilibrium length of the spring).

The back glider 42 can be slidably moved downward along the vertical direction 27 by force exerted by the user's back as the user is seated on the seating surface 22, and the back glider 42 can be slidably moved upward along the vertical direction 27 by force exerted by the spring 44, as the downward force of the user is lessened or removed. The force exerted by the spring 44 on the back glider 42 can facilitate continuous vertical adjustment of the back supporting surface 18 at the same time as the seating surface 22 is moved along the direction of motion 26.

The spring 44 adjusts the height of the back supporting surface 18 relative to the direction of motion 26 as the lower portion 20 of the back supporting surface 18 moves in effect parallel to the direction of motion 26. The vertical travel of the back supporting surface from its resting point (which we sometimes calls it top position) downward will vary but could be as much as 11.43 cm in some implementations. When we refer to motion of one element of the structure that is parallel to motion of another element of the structure, we mean parallel broadly to include, for example, motion by both elements that is along exactly the same path generally along the same path; motion of the elements along respective different paths that extend in the same direction, are equidistant at all points and never converge or diverge; and motion along respective different paths that extend generally in the same direction but may diverge or converge.

In some implementations, the spring 44 is disposed between the back guide 30 and the back glider 42 such that the spring 44 remains substantially concealed during use of the seat 10. This can reduce the likelihood of inadvertent contact with the spring during use, which can improve the safety of operation of the seat 10.

Figure 13:
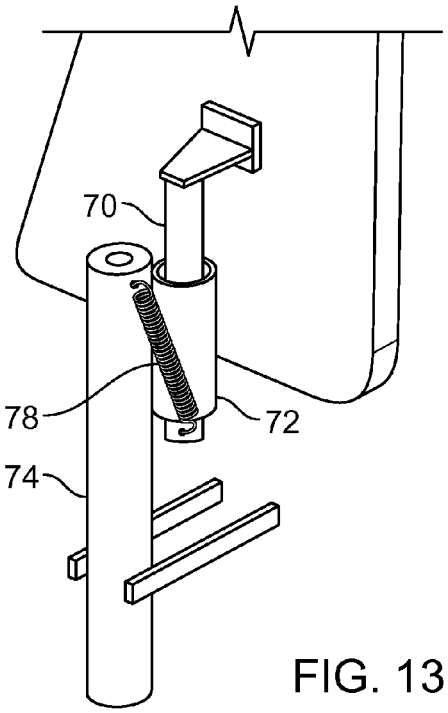
FIG. 13 is a partial perspective view of a seat back support.

As shown in FIG. 13, in some implementations, the back glider can be formed of a tube 70 that can slide vertically within a slightly larger tube 72 that is fixed to a stationary column 74 of the base. The upper ends of extension springs 78 can be mounted on opposite sides of the column (only one spring is shown) and the bottom ends attached to the bottom of the tube 70 to provide the upward biasing force. In some implementations, tubes 70 and 72 can be parts of a gas cylinder that has a compression spring (to provide the upward biasing force) between the bottom inside wall of the tube 72 and the bottom of the tube 70, which is enclosed in the tube 72.

In some implementations, the rotation of the back-supporting surface 18 changes the included angle 59 between the seating surface 22 and the back supporting surface 18, for example, at times when the seating surface 22 moves along the direction of motion 26. In certain implementations, the rotation of the back-supporting surface 18 relative to the seating surface 22 in conjunction with motion of the seat glider along direction 26 causes the included angle 59 to vary through a range from a minimum of about 90 to 100 degrees to a maximum of about 140 to 160 degrees. (The degrees of maximum angle for seating surface to back supporting surface and maximum angle of direction of motion and back supporting surface in testing measures about the same. The measurement should be less for the direction of motion measurement by the difference in the angle of the seat guide and the seat pan which is the angle between the direction of motion and seat pan which can average from 0 degrees to 10 degrees.)

In addition to the components already mentioned, the base 14 includes a column 50, an actuator 52, a support portion 54, and wheels 58. The column 50 extends upward from the support portion 54 into a wedge portion 39 attached to the seat guide 30 in the example shown in the figures, but alternatively or in addition could extend into a tapered cylinder that can be attached to the seat guide in different ways to provide the incline of the seat guide 30. The wedge portion 39 spans the angle between the seat guide 30 and a horizontal floor surface. The support portion 54 is coupled to the wheels 50 to facilitate movement of the seat 10 over the floor surface (e.g., over short distances relative to a desk).

The column 50 can be a gas cylinder such that movement of the actuator 52 (e.g., a lever) changes the height of the column 50 and, thus, the height of the seat guide 30 and the back guide 34 above the floor. The user can adjust the height of the column 50 to achieve comfortable positioning of the user's legs relative to the floor (e.g., a higher height for upright seated positions and a lower height for reclined positions).

The same lever can also be arranged to be able to stop the seat glider from gliding, at any one of a number of positions along its forward and backward path of motion.

Figure 14:
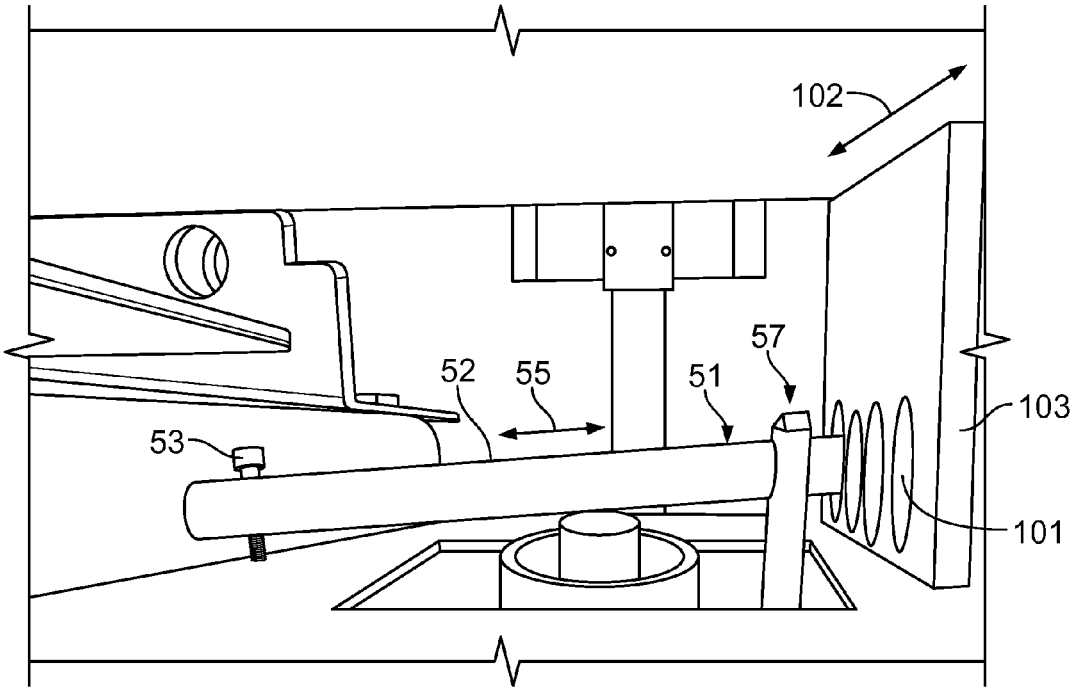
FIG. 14 is a perspective view of a seat guide and a seat glide.

As shown in FIG. 14, for this purpose a series of holes 101 in a metal plate 103 that is attached to the bottom of and along the length of the seat pan 21. Each hole is large enough to accommodate the diameter of the end 51 of the rod of the lever 52. The end 51 is supported in and movable through a hole in a metal support 57 that is fixed to the seat guide. The rod and lever can be moved back and forth to the left and right in the FIG, as indicated by arrows 55. A set screw 53 mounted in the rod serves as a stop to prevent the lever from being pulled to the left so far that the end of the rod would no longer be supported in the hole in the metal support 57.

When the rod is pulled to the left so that the end 51 is withdrawn from any of the holes of the metal plate that is attached to the seat pan that is attached to the seat glider, the seat glider can glide back and forth freely. When the user wishes to stop the gliding motion of the seat glide, the rod can be inserted into any one of the holes 101 to temporarily fix the position of the seating surface at a selected one of a range of different positions along the gliding path. The lever also remains usable to control the top valve of the gas cylinder to control the height of the seating surface as explained above.

Figure 27:
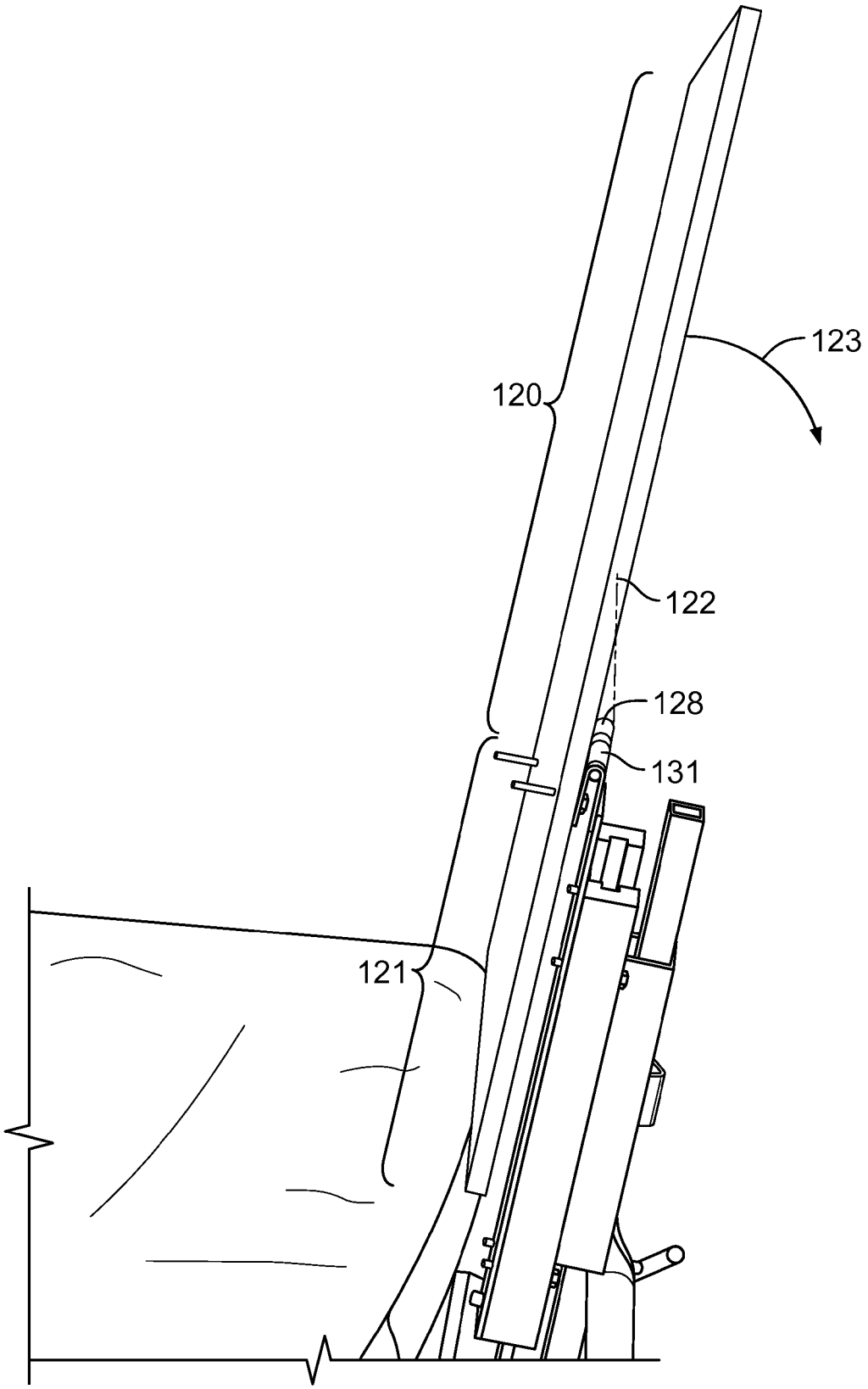
FIGS. 27 through 32 illustrate motion of the seat back.

In many implementations, the axis of rotation of the seat back is in the plane of the seat back and the portion of the seat back above the axis of rotation is heavier than the portion of the seat back below the axis of rotation. As shown in FIG. 27, the latter configuration will exist, for example, if the seat back is uniformly thick and the portion 120 above the hinge is longer than the portion 121 below the hinge. Then the center of gravity 122 of the seat back will lie slightly behind the position of the hinge as shown by the dashed lines. The seat back will therefore tend to rotate backwards 123 when the seat is not occupied. In some examples, the rotation backwards can be and is stopped before the seat back rotates beyond a predetermined position (for example upside down) by the detent mentioned earlier. The detent 131 can take the form of a bolt that is attached to or otherwise interacts with the hinge that forms the axis of rotation of the seat back, so that the extent of rotation is limited when the rotation reaches a predetermined angle. A wide variety of other arrangements are possible to reduce or stop the rotation of the seat back. And the angle at which rotation will be reduced or stopped can be altered, either by design or by the user in some implementations. Even with the detent, the rotation of the seat back can make the chair appear to be broken. In some implementations, therefore, the seat back is mounted forward so that its center of gravity is directly above the axis of rotation (that is, is in a natural balance point) when the seat back is in what appears to be a normal generally upright position. The detent is then placed to stop the rotation of the seat back just before the seat back reaches the balance point at which the seat back is generally upright. Then, when an individual gets off the chair, the back rotates to the vertical-neutral position and stops. Hence, there is no appearance of a broken chair.

Figure 28:
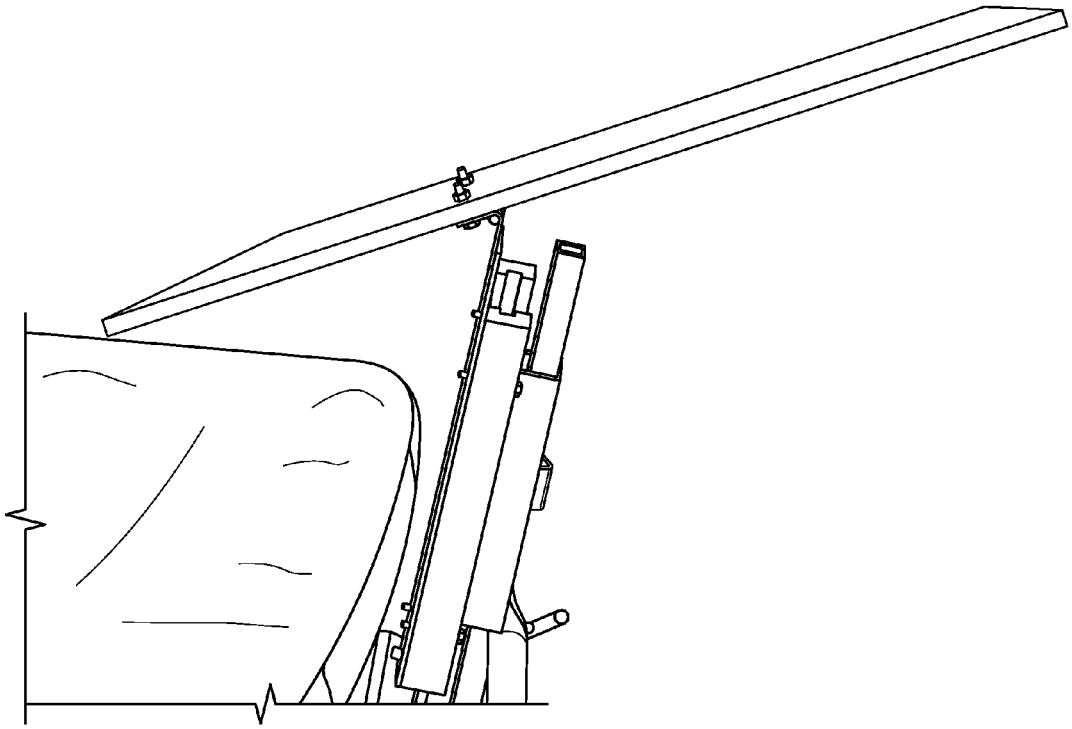
Figure 29:
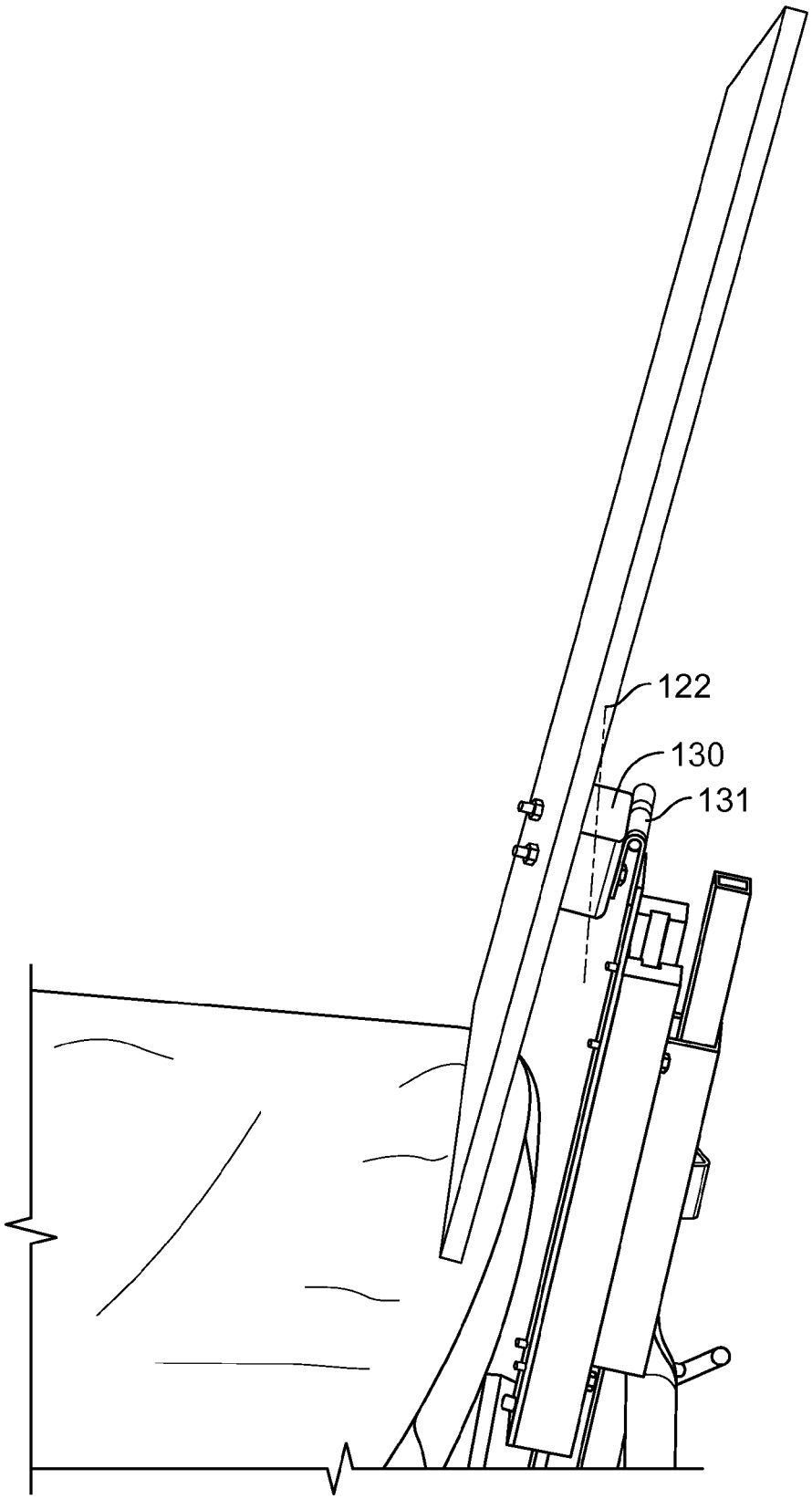
Figure 30:
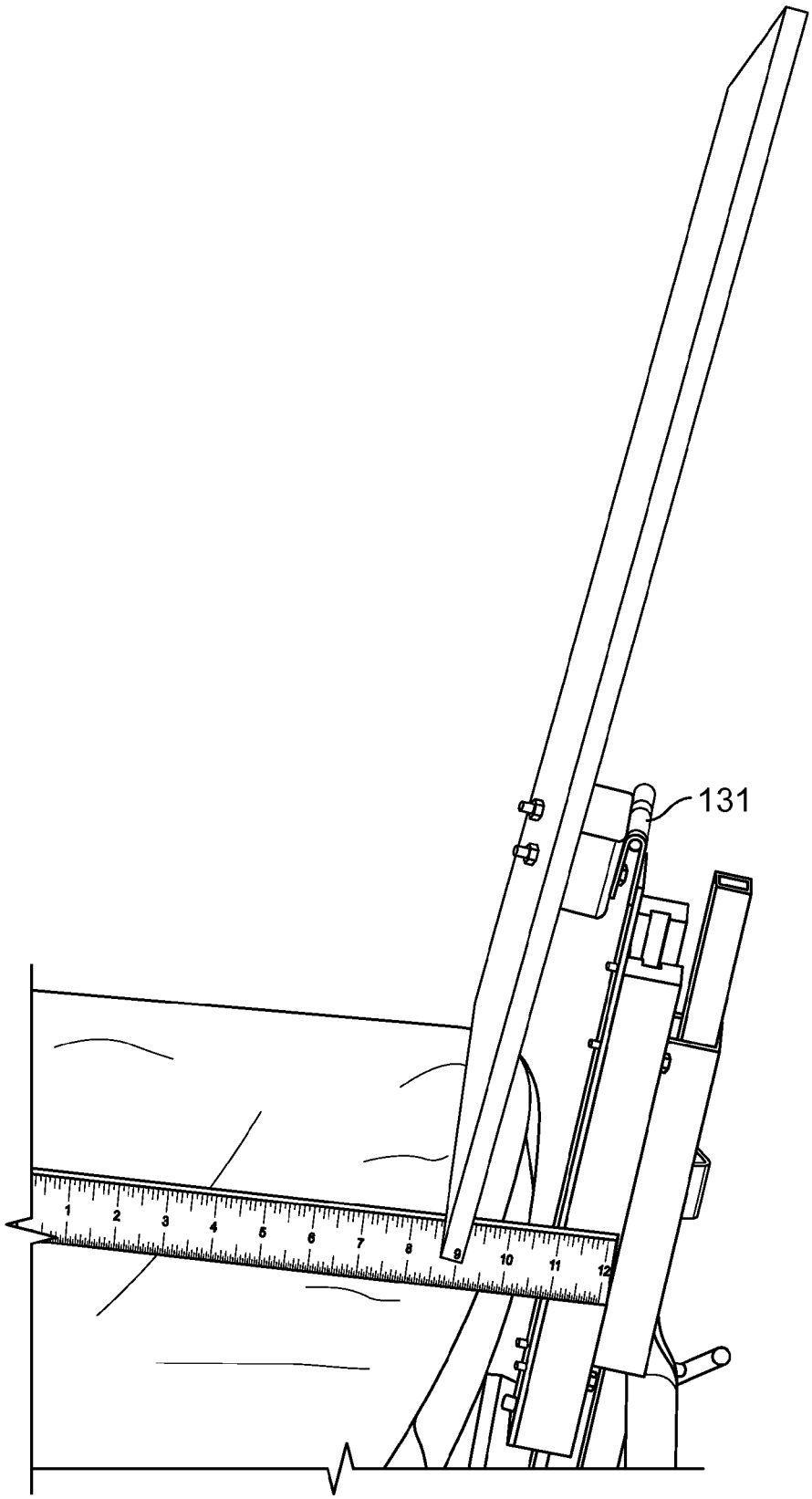
Figure 31:
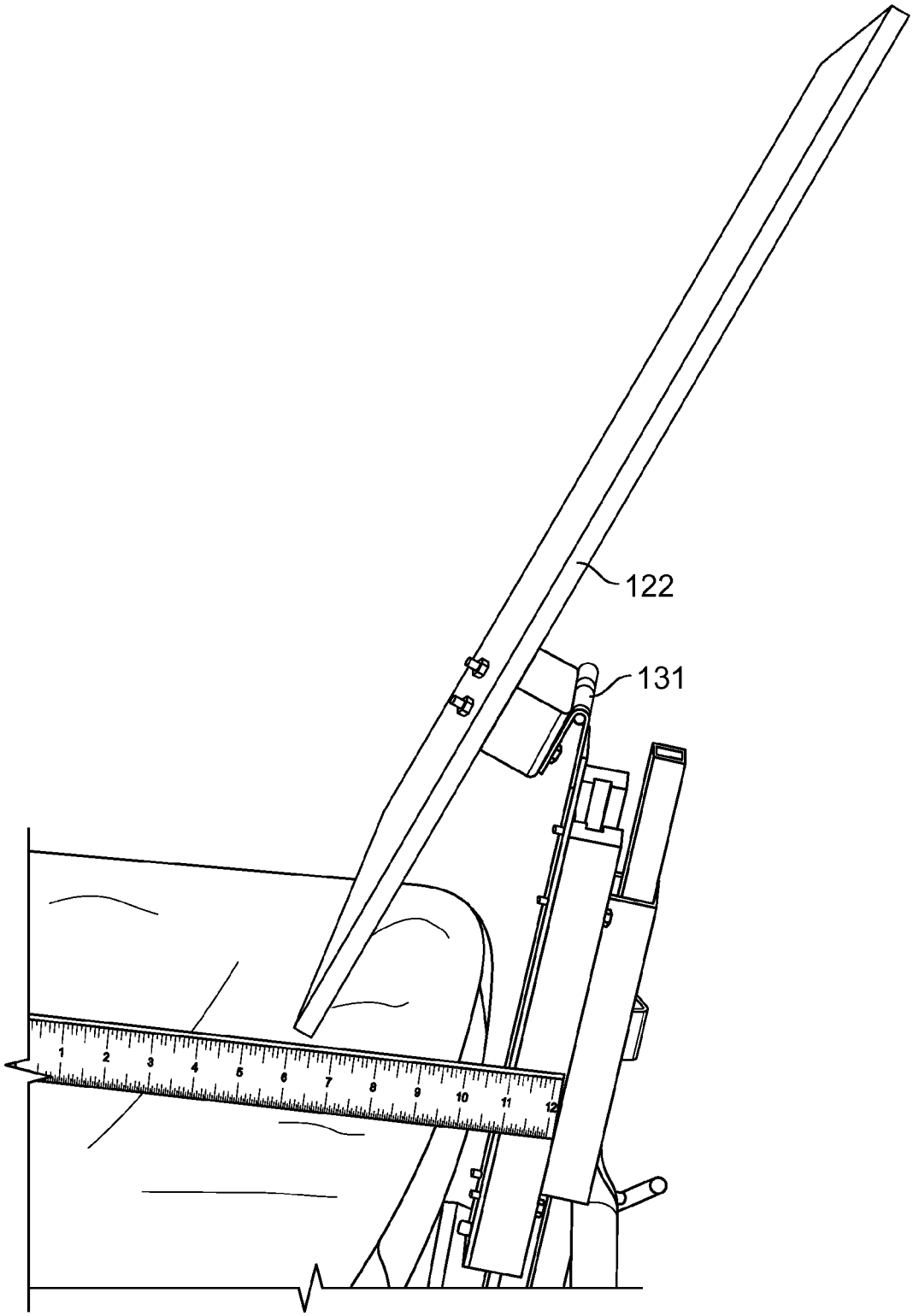
Figure 32:
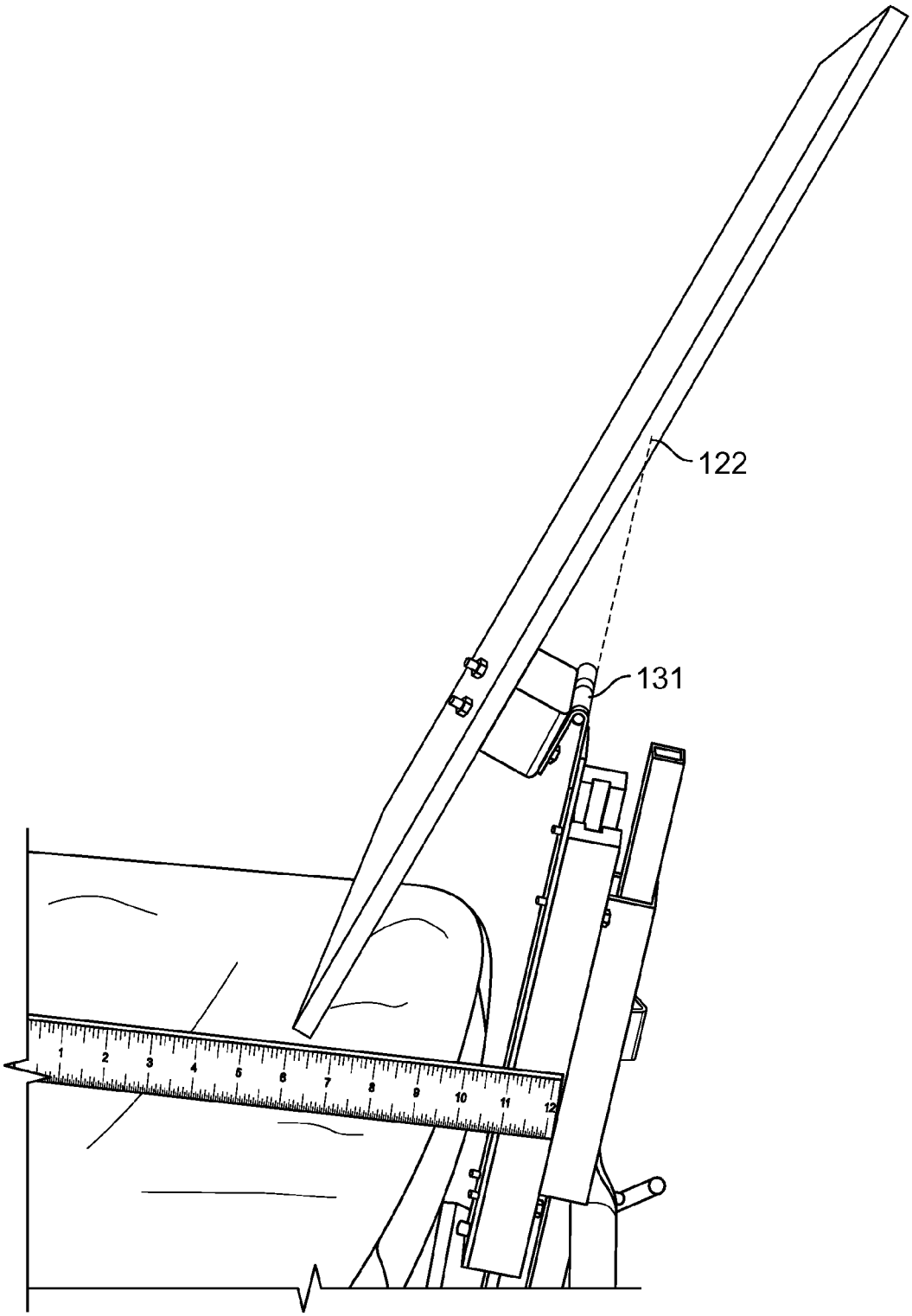

This arrangement is illustrated as follows. In FIG. 27, the seat back is shown with the axis of rotation 128 in the plane of seat back. The seat back must be held (as it is being held in the FIG) to remain upright. In the FIG, the seat is being held in its fully forward position with the hinge, which is fully closed, preventing any further rotation forward. However rearward rotation is possible, and, if the individual holding the back in place releases the back, the back rotates back 23 until the detent stops it (preventing it from flopping all the way over). In FIG. 28, after the back is released, the seat back has rotated back to its resting position against the detent and the chair may appear to be broken. In FIGS. 29 and 30, the seat back has been re-attached to be more forward of the axis of rotation using a block 130. Now the center of gravity of the seat back is forward of the hinge which tends to bias its rotation forward to its upright position where it does not look broken. Therefore, the seat back remains naturally balanced in an essentially vertical position without being held. In FIG. 31, the seat back has been rotated relative to its position in FIG. 30 so that the center of gravity is now exactly above the hinge and the seat back is balanced. From the position in FIG. 30, the slightest rotation forward of the seat back will place the center of gravity forward of the hinge and the seat will automatically be rotated to the position of FIG. 30.

When the seat is in use, movements of the back support 16 and the seat pan 21 change the seating position of the user. Because the back support and seat pan can be frequently or continually changed, the user can make continuous positional adjustments while seated on the seat 10. In some instances, these continuous adjustments can facilitate strengthening the user's anatomical core muscles (e.g., abdominal muscles, oblique muscles, erector spinae, etc.) or allow the user to burn more calories or cause motion of spinal joints which enhances nourishment of the joints and prevents degeneration of the joints as compared to passively sitting on a non-adjustable seat or achieve any combination of two or more of these benefits. Additionally or alternatively, the relative movements of the back support 16 and the seat pan 21 allow the back support 16 to maintain consistent support on the user's back (e.g., a lumbar portion of the user's back) over a range of adjustable seating positions, reducing the likelihood of injury to the user.

Figure 10A:
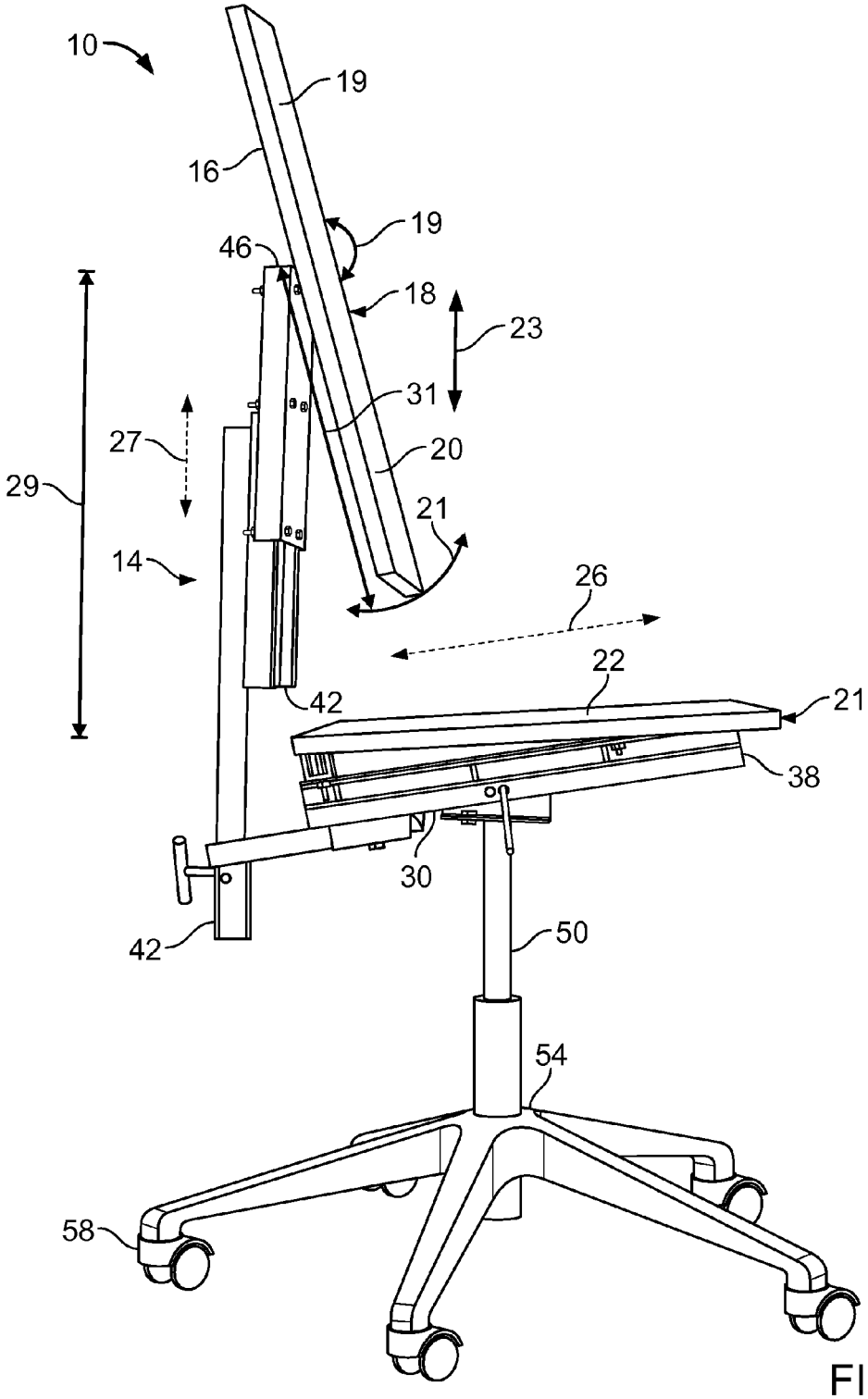
FIGS. 10A-10B are schematic illustrations of the change in configuration of the seat of FIG. 1 between the first position and the second position.
Figure 10B:
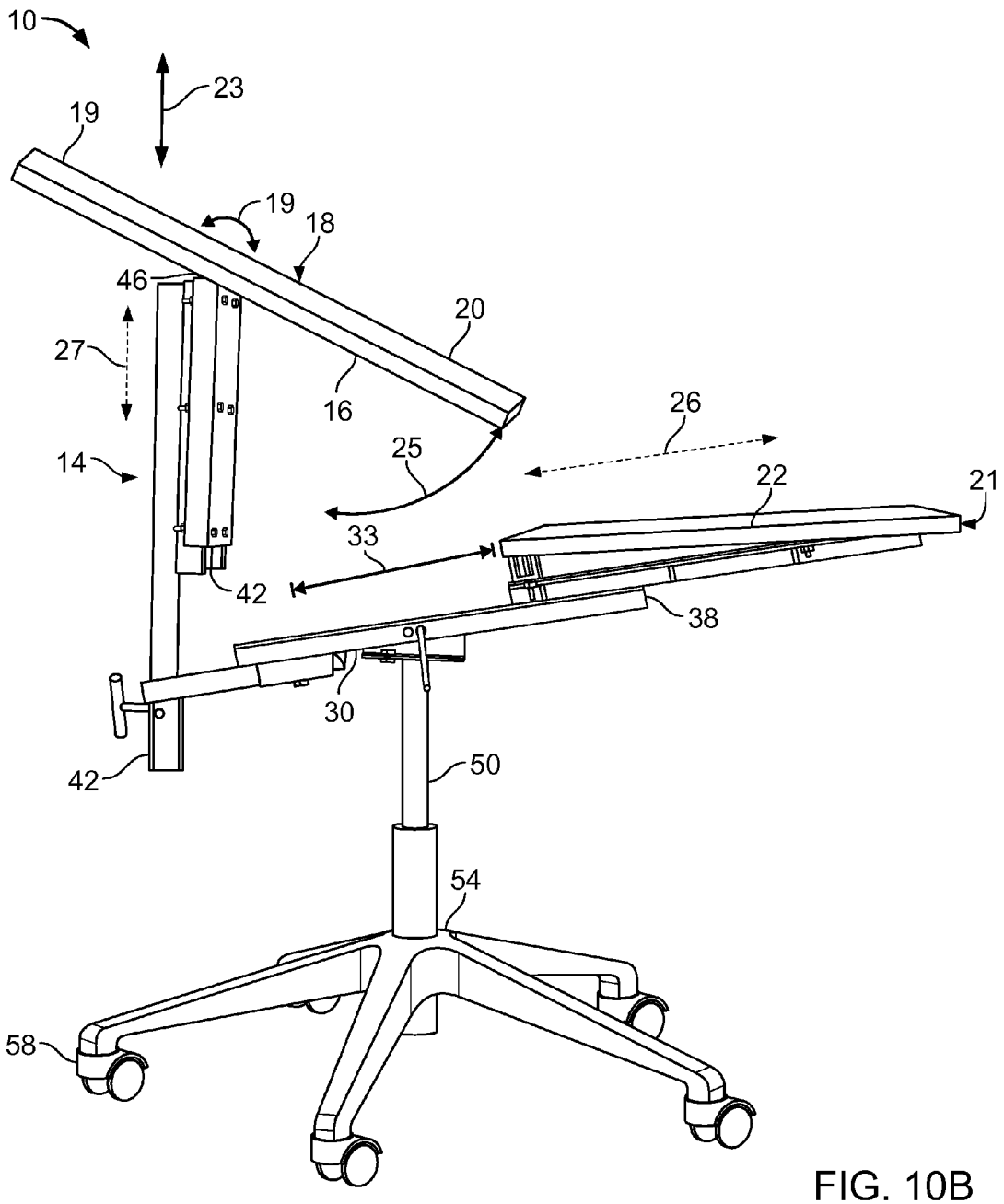

Referring specifically now to FIGS. 10A-10B, the relative movement of the back-supporting surface 18 and the seating surface 22 results in a continuously adjustable seating position that provides consistent support to the user's back (e.g., each point of the back supporting surface 18 remains in contact with a corresponding point on the user's back, as the user slides the seating surface 22 along the direction of motion 26).

This effect is achieved by a somewhat complicated motion of the back supporting surface 18 and its lower portion 20 relative to the seating surface 22 and the motion of the seating surface back and forth along the direction 26. The back-supporting surface 18 is mounted to permit it to rotate 19 about the horizontal rotational axis 46. The axis in turn is mounted to permit it (and the back supporting surface that is held on it) to move up and down 27. The seating surface is mounted to be able to glide back and forth along the direction 26. The movements of back supporting surface and the seating surface occur in response to movements and forces of the user, the force of gravity, and the upward biasing force applied to the back glide.

As the back-supporting surface 18 rotates about the axis 46, its lower portion 20 would (if there were no vertical motion 27) follow an arc 21. The back-supporting surface 18, however, can move vertically at the same time it is rotating about axis 46. As a result of the combination of the rotation and downward movement, the lower portion 20 will tend to traverse a path 25 that is not an arc of a circle but, in some implementations, is essentially parallel to the motion of the seating surface 22 back and forth along the direction 26. Because of this motion, the position of the bottom of the back supporting surface relative to the rear of the seating surface will not change significantly even though the user's body is moving and shifting significantly.

The length of travel of the lower portion 20 of the back supporting surface along path 25 is mainly determined by the length 31 of the portion of the back-supporting surface below the axis and the height 29 of the axis relative to the seating surface (both heights being adjustable). For example, if the height 29 is 22.86 cm (9 inches), then the lower portion 20 can move almost that distance 33 essentially parallel to the direction of motion 26 of the seating surface 22.

In some implementations, the back supporting surface 18 is not encumbered in its motion by attachment to any part of the seat guide. The back supporting surface is attached to the back glide which glides on the back guide which is attached to the J bar which is attached to the seat guide. However, this does not encumber the rotation of the back supporting surface at all. It does not encumber the vertical motion within the amount the spring allows. The parts that rotate and glide vertically are not attached to the seat guide]. Without a user occupying the seat, the amount of rotation 19 of the back supporting surface therefore can be 90° or greater about the axis 46 and the length of travel of the bottom of the back supporting surface along path 25 is only limited by the length of 20 from the lower end of the back supporting surface to the axis 46.

Figure 24:
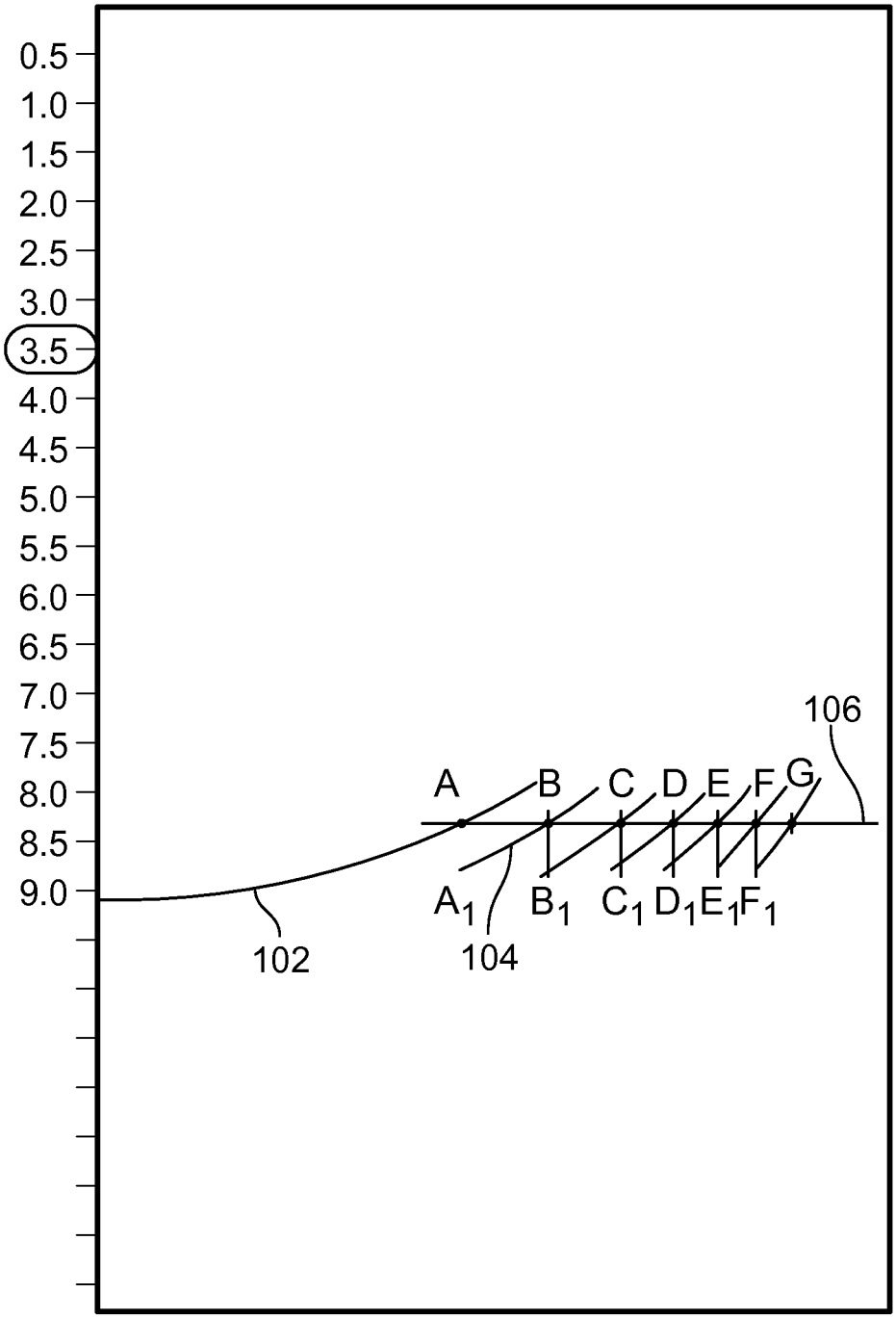
FIGS. 24, 25, and 26 are motion curves.

When a user is on the seat, the rotation of the back supporting surface and the and gliding of the seat glider are functions of, for example, the size, weight, and proportions of the user and the conscious and subconscious responses and biofeedback of the user. As shown in FIG. 24, a likely initial path of the bottom edge of the back supporting surface is a smooth continuous curve 102 as the user forces the back supporting surface to rotate about its axis. (The numbers along the left axis in the figure represent inches distance from the starting axis of rotation when the spring is at resting point. The axis of rotation is generally assumed to be at 0.5 inches in the figures except when it is pushed downward by the user to a lower position.) At point A, it is assumed that the user forces the back supporting surface downward 27 to a new starting point and then forces a rotation of the back supporting surface so that the bottom of the back supporting surface follows the path from A to B. And the process is repeated at locations B, C, D, and E in a regular repetitive cadence of vertical drop and forward progression. In overall effect the points A through E are connectable by a straight path 106 that is substantially parallel to the direction of motion of the seat glider. In FIG. 24, the distances from point A to B, B to C, C to D, D to E, E to F, and F to G are successively smaller and smaller. In effect, the rotation of the back supporting surface has less and less effect on the motion of the bottom of that surface along path 106, which is a function of the geometry of the back supporting surface and its axis of support.

Figure 25:
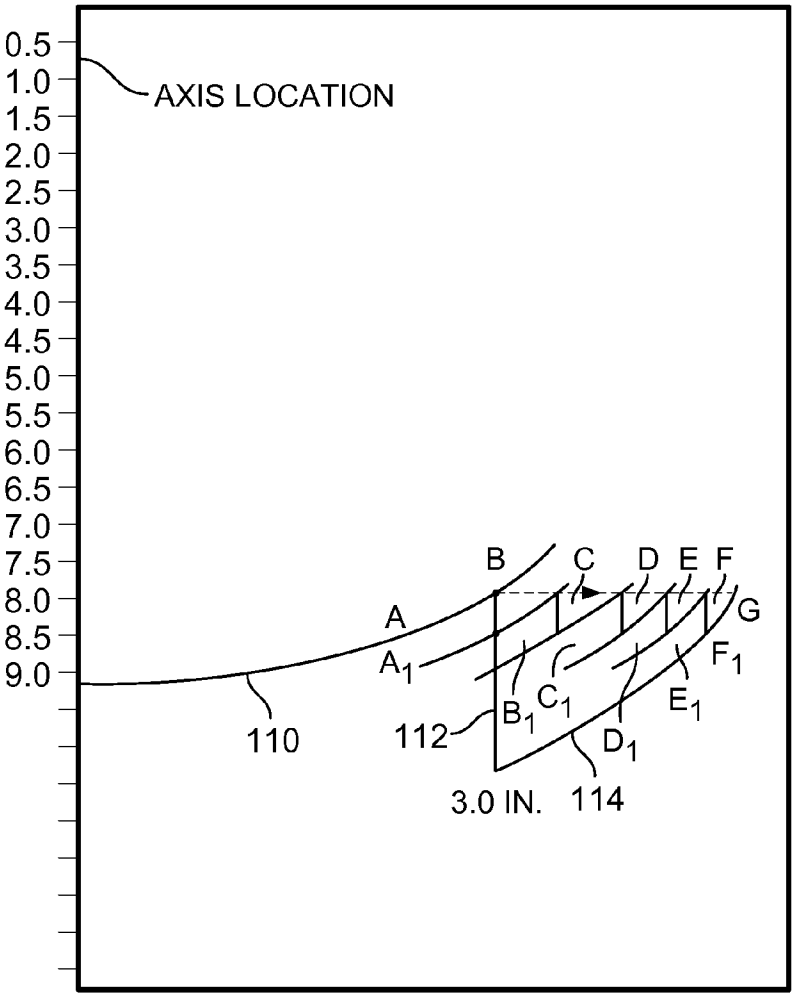

As shown in FIG. 25, in another sequence, the back supporting surface is rotated through a path 110, then a vertical drop 112 of 3.5 inches occurs, and the surface is rotated again 114 to reach point G.

Figure 26:
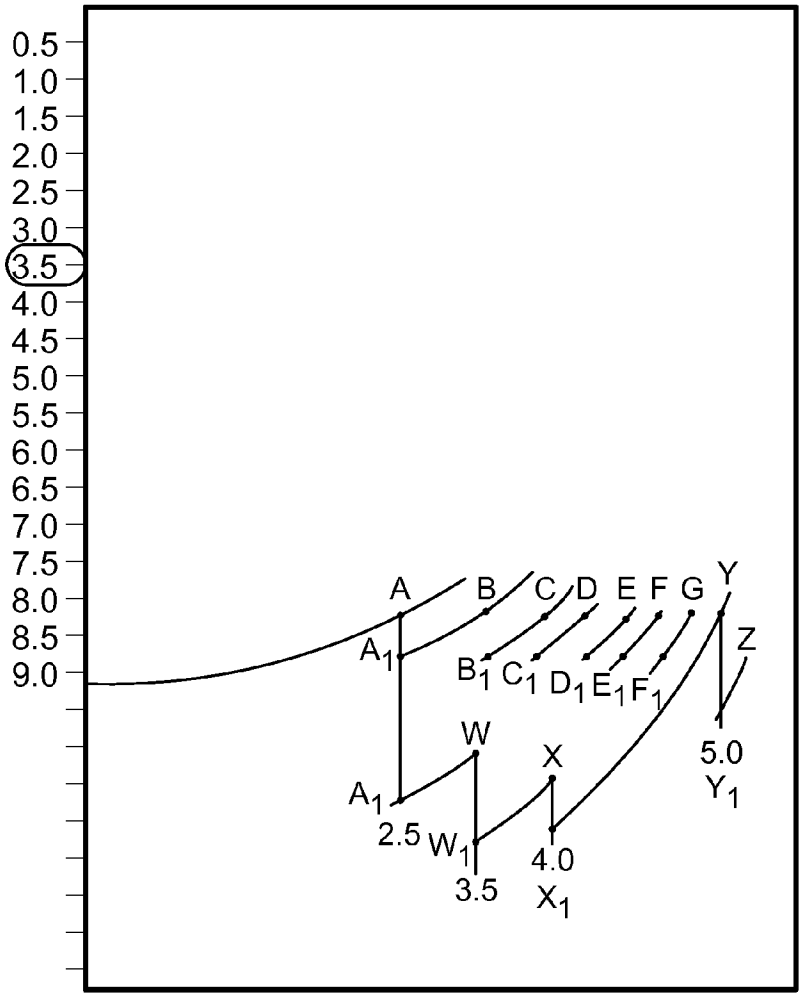

In some uses, the user could stop the motion of the vertical glide or limit the rate of vertical glide motion and accentuate the rotation of the back supporting surface to cause a variation of the path of the end of the lower seat back. In some uses, the user could stop or limit the rotation and emphasize the vertical glide motion. A wide variety of motion paths can result. In some cases, the back-supporting surface only rotates through an arc to a point where the path of the lower end of the back supporting surface is essentially parallel to the motion of the seating surface or the path is any combination of an arc and a parallel path (which is a flattened arc). The range of possible motions can yield many beneficial and varying affects with the outcome of comfort and health. A more complicated example is shown in FIG. 26 in which the path includes an initial rotation with the axis at 0.5 inches followed by paths from A to A1, from A1 to W (for which the axis of rotation has been pushed down to 2.5 inches), W to W1, W1 to X (axis pushed down to 3.5 inches), X to X1, X1 to Y (axis at 4.0 inches), Y to Y1, and Y1 to Z (axis at 5.0 inches).

In many implementations the path of the bottom of the back support surface is a flattened arc. In FIGS. 10A and 10B note how the arc 21 in 10A becomes the flattened arc 25 in 10B as a result of the axis 46 lowering.

The varying of the orientation of the back-supporting surface 18 is based at least in part on a force exerted by the back of the user seated on the seating surface 22 as the seating surface 22 moves forward or backward in the direction of motion 26. The orientation of the back-supporting surface 18 can vary as the user leans back in the seat 10 to push the seating surface 22 forward, and away from the back glide, along the direction of motion 26. Additionally or alternatively, the orientation of the back-supporting surface 18 can vary as the user leans forward (or otherwise reduces the amount of force on the back-supporting surface 18) in the seat to allow the seating surface 22 to move backward toward the back glide, along the direction of motion 26.

Varying the orientation of the back-supporting surface 18 includes changing an included angle between the seating surface 22 and the back-supporting surface 18. For example, rotation of the back-supporting surface 18 about the hinge 46 (e.g., about a rotational axis parallel to the back supporting surface 18 and parallel to the seating surface 18) can change the included angle between the seating surface 22 and the back-supporting surface 18. In some implementations, a force exerted by the upper back of the user on the upper portion 19 of the back-supporting surface 18 rotates the back-supporting surface 18 about the hinge 46.

Varying the orientation of the back-supporting surface 18 also includes changing the position of the back-supporting surface 18 along the vertical axis 27. The force exerted by the user leaning back in the seat 10 to push the seating surface 22 away from the back-supporting surface 18 also acts to move the back-supporting surface 18 downward, in a direction toward the direction of motion 26. Thus, as the user leans back in the seat 10 to push the seating surface 22 away from the back-supporting surface 18, the back-supporting surface 18 undergoes both vertical motion and rotational motion. The reverse movement by the user results in reverse vertical and rotational motion to allow the seating surface 22 to move toward the back-supporting surface 18.

This relative change in positioning of the back-supporting surface 18 relative to the seating surface 22 can provide consistent support to the lumbar portion of the user's back as the user moves through a variety of reclining angles (e.g., from an upright seated position to a reclined or anticlinal position). For example, the lower portion 20 of the back-supporting surface 18 can remain in contact with the same point of the user's back as the user moves through various reclining angles. Additionally or alternatively, the combined vertical and rotational motion of the back-supporting surface 18 can allow the upper portion 19 of the back supporting surface 18 to provide consistent support to the upper portion of the user's back as the user moves through the variety of angles of inclination.

Varying the orientation of the back-supporting surface 18 can also include continuously varying the orientation of the back-supporting surface 18 as the seating surface 22 moves along the direction of motion 26. For example, the combined vertical and rotational movement of the back-supporting surface 18 relative to the seating surface 22 is self-adjusting (e.g., through the balancing of the vertical and rotational forces exerted by the user on the back-supporting surface 18 and the force exerted by the user on the seating surface 22), allowing the user to make continuous minor adjustments to the sitting position and/or larger adjustments to the sitting position. By facilitating continuous minor adjustments to the sitting position, the seat 10 can facilitate burning more calories by the user, as compared to sitting passively. Additionally or alternatively, by facilitating continuous minor adjustments to the sitting position, the seat 10 can reduce the likelihood of injury resulting from prolonged periods of sitting (e.g., by enhancing blood flow to nourish the joints of the user and by motion of the joints which allows imbibition and exposure of the articular surfaces for synovial fluid nourishment). Additionally or alternatively, by facilitating continuous minor adjustments to the sitting position, the seat 10 can facilitate strengthening the user's anatomical core muscles while providing ergonomic support.

While certain implementations have been described, other implementations are possible.

Figure 11:
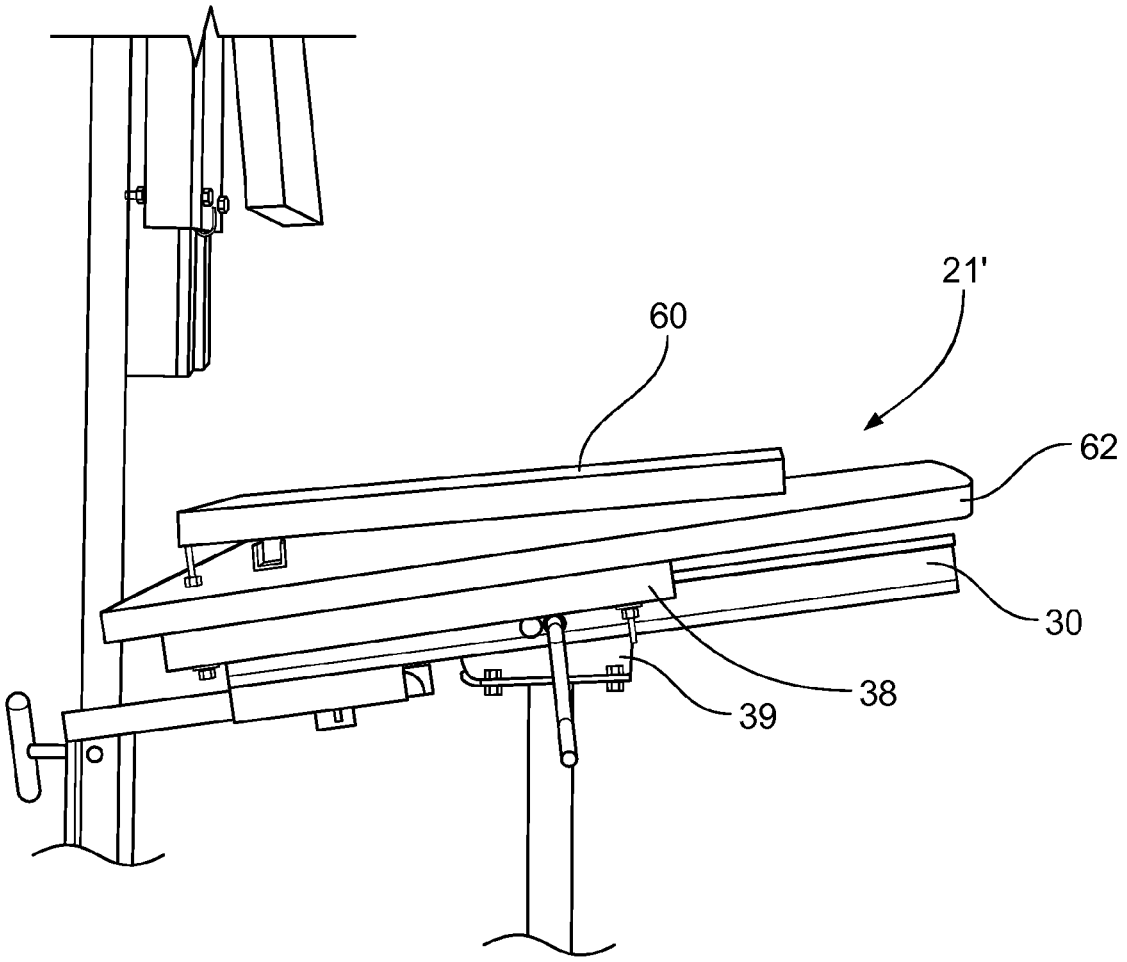
FIG. 11 is a side view of a seat pan of a seat.

For example, while the seat pan has been described as being a single horizontal piece, other implementations are additionally or alternatively possible. As shown in FIG. 11, for example, a seat pan 21' can include an upper seat pan 60 and a lower seat pan 62. The lower seat pan 62 can be coupled to the seat glider 38 and angled parallel to the seat glider 38. The upper seat pan 60 can be coupled to the lower seat pan 62 and disposed in a substantially horizontal orientation during use.

Figure 12:
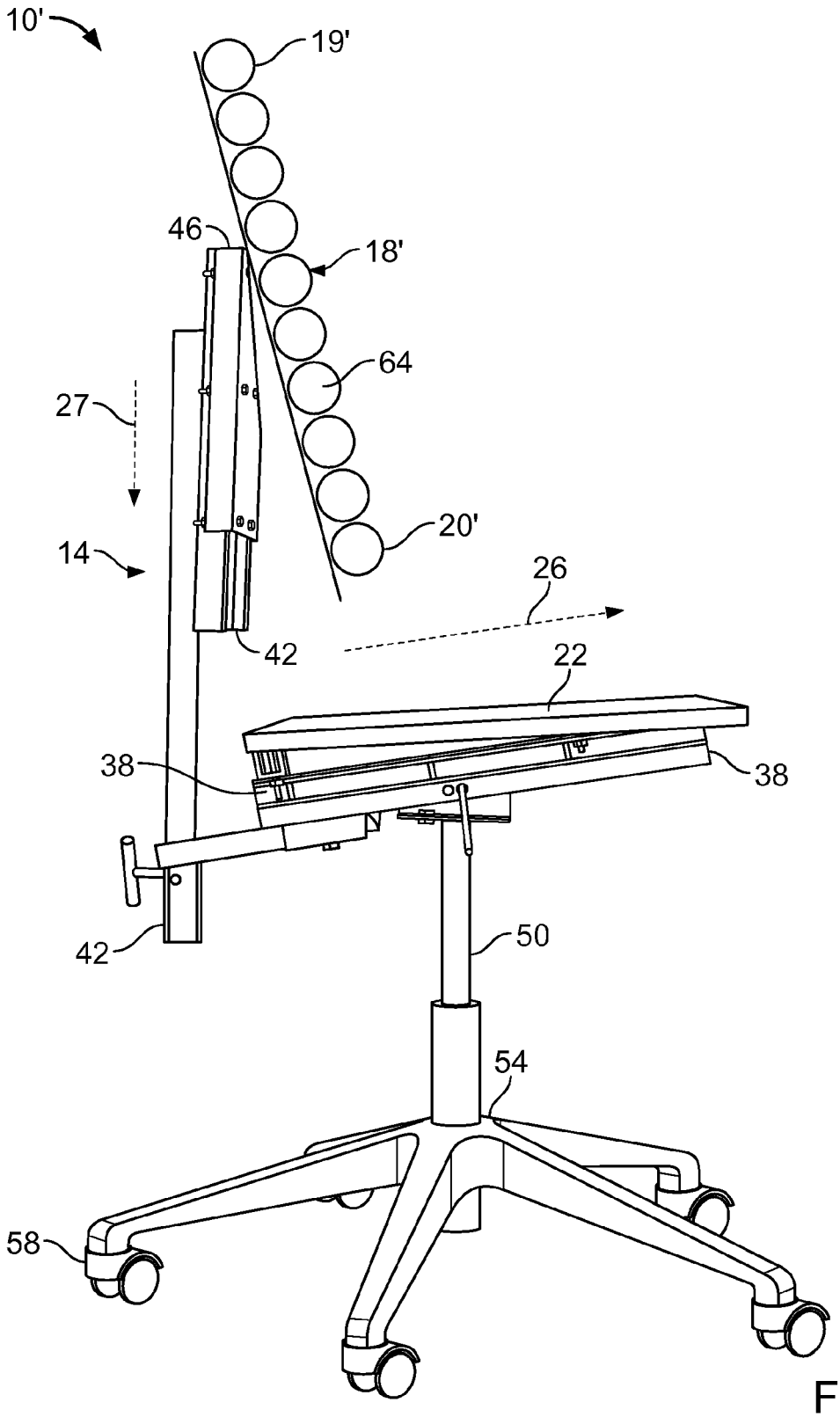
FIG. 12 is a side view of a seat.

As another example, while the back-supporting surface has been described as a planar or contoured surface, other implementations are additionally or alternatively possible. As shown in FIG. 12, for example, a seat 10' can include a back-supporting surface 18' can include rollers 64 spanning at least a portion of the back-supporting surface 18', from a lower portion 20' of the back-supporting surface 18' to an upper portion 19' of the back-supporting surface 18'. Each roller 64 is substantially cylindrical and independently movable relative to each of the other rollers 64 such that movement of the back-supporting surface 18' can result in a rolling motion of the rollers 64 relative to the user's back to provide, for example, a massaging effect for the points of contact on the user's back. In some implementations, the rollers 64 can include surface features (e.g., ridges and/or bumps), which can further enhance the massaging effect on the user's back.

As another example, while the base has been described as including wheels, other implementations are additionally or alternatively possible. For example, the base can include a plurality of legs for stationary contact with a floor surface.

As still another example, while the back-supporting surface and the seating surface have been described as movable under the power of a user, other implementations are additionally or alternatively possible. For example, one or more of the back-supporting surface and the seating surface can be movable through an external force, such as a force exerted by a motor. The use of external force to move the back-supporting surface and the seating surface can, for example, reduce the risk of chronic inflammation in users (e.g., individuals with some form of paralysis) who may otherwise be unable to move the back-supporting surface and/or the seating surface. Or a practitioner might use methods to control the various motions.

One or more of the back-supporting surface and the seating surface can be stopped along their respective directions of movement. In some implementations, the user can actuate a manual brake that stops movement of the back-supporting surface and/or the seating surface. In certain implementations, the user can actuate a brake to stop movement of the back-supporting surface or the seating surface, while the other one of the back-supporting surface or the seating surface remains movable. Braking the back-supporting surface or the seating surface or both can assist the user in tailoring the movement of the chair to achieve a particular therapeutic goal or allow the user to engage in movement as desired, while remaining stationary at other times, or both.

The invention claimed is:

1. An apparatus comprising:

a base;

a seating surface, a back-supporting surface, a rotational mechanism to enable the back-supporting surface to rotate about an axis that is higher from a floor than is the seating surface, the rotational mechanism comprising a first element and a second element, the back-supporting surface and the first element being coupled for rotation about the axis relative to the second element in response to motion of a person sitting on the seating surface, the seating surface being movable relative to the base toward and away from a vertical plane that contains the axis, and an axis-transferring mechanism having a first element and a second element that are both together coupled between the second element of the rotational mechanism and the base and are movable relative to one another to transfer the axis toward and away from a floor, the first and second elements of the axis-transferring mechanism having at least one mode of operation in which they are movable relative to one another separately from the rotation of the back-supporting surface and the first element of the rotational mechanism relative to the second element of the rotational mechanism, the first element of the axis-transferring mechanism being coupled to the second element of the rotational mechanism, and the second element of the axis-transferring mechanism being coupled to the base, the axis being transferred, by motion of the first element of the axis-transferring mechanism relative to the second element of the axis-transferring mechanism, the axis being transferred toward the floor in response to an amount of force applied by the back of a person sitting on the seating surface and away from the floor in response to a lesser amount of force applied by the back of the person sitting on the seating surface.

2. The apparatus of claim 1, wherein a lower portion of the back-supporting surface is movable in response to force exerted by a back of a user seated on the seating surface as the seating surface moves along the base.

3. The apparatus of claim 2 in which a lower portion of the back supporting surface is movable in response to force exerted by a back of a user seated on the seating surface as the seating surface remains stationary.

4. The apparatus of claim 1, wherein the seating surface moves while the back supporting surface remains stationary.

5. The apparatus of claim 1, wherein a lower portion of the back-supporting surface moves generally parallel to the motion of the seating surface as the seating surface moves along an entire length of travel.

6. The apparatus of claim 1, wherein a lower portion of the back-supporting surface moves generally parallel to the motion of the seating surface relative to the base toward and away from the vertical plane that contains the axis for a maximum distance of between about 22.8 cm and about 33 cm as the seating surface moves.

7. The apparatus of claim 1, wherein movement of the back-supporting surface relative to the seating surface changes an included angle between the seating surface and the back supporting surface as the seating surface moves relative to the base.

8. The apparatus of claim 7, wherein a minimum included angle between the seating surface and the back-supporting surface is between about 90 degrees and about 100 degrees.

9. The apparatus of claim 7, wherein a maximum included angle between the seating surface and the back-supporting surface is between about 140 degrees and about 160 degrees.

10. The apparatus of claim 7, wherein a minimum included angle between the motion of the seating surface and the back-supporting surface is between about 80 degrees and about 90 degrees and the maximum included angle between the motion of the seating surface and the back-supporting surface is between about 140 degrees and about 160 degrees.

11. The apparatus of claim 1, wherein the seating surface is biased to move toward the back-supporting surface.

12. The apparatus of claim 11, wherein the seating surface is biased to move toward the back-supporting surface under the force of gravity.

13. The apparatus of claim 1, wherein the axis is parallel to the back-supporting surface and parallel to the seating surface.

14. The apparatus of claim 13, wherein the axis of rotation of the back-supporting surface and the motion of the seating surface are non-convergent.

15. The apparatus of claim 13, wherein the back-supporting surface is movable in a direction perpendicular to the seating surface.

16. The apparatus of claim 15, wherein movement of the back-supporting surface in the direction perpendicular to the seating surface changes a distance between a lower portion of the back-supporting surface and the seating surface.

17. The apparatus of claim 15, wherein the back-supporting surface is biased to move away from the seating surface in the direction perpendicular to the seating surface.

18. The apparatus of claim 15, further comprising a spring, the spring biasing movement of the back-supporting surface away from the seating surface in the direction perpendicular to the seating surface.

19. The apparatus of claim 13, wherein the axis of rotation of the back-supporting surface is between lower and upper portions of the back-supporting surface.

20. The apparatus of claim 1, wherein the motion of the seating surface is oblique to the seating surface.

21. The apparatus of claim 20, wherein the motion of the seating surface is inclined in a direction away from the back-supporting surface.

22. The apparatus of claim 1 in which the motion of the seating surface is parallel to the seating surface.

23. The apparatus of claim 1, wherein an included angle between the seating surface and the motion of the seating surface is constant as the seating surface moves.

24. The apparatus of claim 1, wherein the seating surface is slidably movable relative to the base.

25. The apparatus of claim 1 comprising a chair.

26. The apparatus of claim 1, further comprising a spacer disposed between the seating surface and the base, the spacer is fixed relative to the seating surface and slidably movable relative to the base, wherein the seating surface is oblique to the motion of the seating surface and the spacer spans an included angle between the motion of the seating surface and the seating surface.

27. The apparatus of claim 1, wherein the back-supporting surface is slidably movable relative to the base.

28. The apparatus of claim 1, wherein the base comprises wheels to move the apparatus on the floor.

29. The apparatus of claim 1, wherein the base is adjustable in a direction relative to the floor.

30. The apparatus of claim 1, wherein the base comprises a gas cylinder actuatable to move the base relative to a floor.

31. The apparatus of claim 1, wherein a back support comprises at least one roller in contact with a back of a user seated on the seating surface.

32. The apparatus of claim 1 in which:

the back-supporting surface and the seating surface are independently movable relative to one another, and the back-supporting surface is movable, while a sitter is using the apparatus and in contact with the back-supporting surface and the seating surface, simultaneously (a) to push the user away from the back-supporting surface or to push the seating surface away from the back-supporting surface as part of the motion of the seating surface toward and away from the vertical plane, or both, and (b) to vary an included angle between the back-supporting surface and the seating surface.

33. The apparatus of claim 32, wherein the back-supporting surface is movable in response to a force exerted on the back-supporting surface by the user.

34. The apparatus of claim 32, wherein the back-supporting surface is movable in response to motorized force exerted on the back-supporting surface.

35. The apparatus of claim 32 wherein the seat surface is movable in response to a motorized force exerted on the seat surface or to another external force other than the user.

36. The apparatus of claim 32, wherein the back-supporting surface is movable in response to manual methods exerted on the back-supporting surface.

37. The apparatus of claim 32, wherein the back-supporting surface is movable in a direction substantially perpendicular to the seating surface.

38. The apparatus of claim 32, wherein the back-supporting surface comprises a lower portion nearer the seating surface and an upper portion that is farther from the seating surface, and the back-supporting surface is rotatable about the axis between the upper and lower portions of the back-supporting surface.

39. The apparatus of claim 38, wherein the axis is movable in a direction perpendicular to the seating surface to change a point of contact between a back of the user and the lower portion of the back-supporting surface.

40. The apparatus of claim 38, wherein the axis is movable in a direction perpendicular to the seating surface to change a point of contact between a back of the user and the upper portion of the back-supporting surface.

41. The apparatus of claim 32, wherein the height of the back-supporting surface relative to the seating surface is adjustable.

42. The apparatus of claim 32, wherein the seating surface is slidably mounted on a seat guide that is fixed on the base and a horizontal distance of the back-supporting surface from the seat guide is adjustable.

43. The apparatus of claim 32 comprising a stopping mechanism to limit a range of motion of the seating surface as it moves relative to the base toward and away from a vertical plane that contains the axis.

44. The apparatus of claim 1 comprising a mechanism to slow or stop motion of the seating surface at one or more positions along its motion relative to the base.

45. The apparatus of claim 1 comprising a mechanism to slow or stop motion of the back supporting surface.

46. The apparatus of claim 1 comprising a mechanism for adjustably controlling an arc of rotation of a lower portion of the back supporting surface.

47. The apparatus of claim 46 in which the mechanism comprises a detent.

48. The apparatus of claim 1 comprising a device to control a path of the motion of the back supporting surface.

49. The apparatus of claim 1 comprising a device to control the motion of the seating surface.

50. The apparatus of claim 1 comprising a mechanism to enable vertical adjustment of a position of the back supporting surface relative to the seating surface.

51. The apparatus of claim 1 comprising a mechanism to enable the back supporting surface to be adjusted horizontally relative to the seating surface.

52. The apparatus of claim 1 comprising a mechanism to enable the seating surface to be adjustable horizontally relative to the back supporting surface.

53. The apparatus of claim 1 comprising a mechanism to adjust a vertical height of the back supporting surface above the floor.

54. The apparatus of claim 1 in which the seating surface is parallel to the motion of the seating surface.

55. The apparatus of claim 1 comprising arms.

56. The apparatus of claim 55 in which the arms are attached to a seat glide, the back support, a seat guide, the back supporting surface, or the base.

57. The apparatus of claim 55 in which the arms have storage areas.

58. The apparatus of claim 1 comprising storage areas.

59. The apparatus of claim 1 comprising a foot stool.

60. The apparatus of claim 59 in which the foot stool is foldable.

61. The apparatus of claim 59 in which the foot stool extends out for use in connection with an ample degree of re-anticline.

62. The apparatus of claim 1 comprising a work surface.

63. The apparatus of claim 62 in which the work surface extends transversely over the user.

64. The apparatus of claim 1 in which the axis-transferring mechanism enables up and down motion of the axis during use by a sitter who is sitting on the seating surface relative to the base independently of the motion of the seating surface relative to the base.

65. The apparatus of claim 64 in which the axis-transferring mechanism is biased to move the back-supporting surface up to a rest position when no force is being applied to move the back-supporting surface down.

66. The apparatus of claim 64 in which the axis-transferring mechanism provides a resting vertical position for the back-supporting surface, and the resting vertical position can be adjusted up and down manually.

67. The apparatus of claim 1 in which while the seating surface moves relative to the base, the axis-transferring mechanism simultaneously enables up and down motion of the back supporting surface relative to the base, and rotation of the back-supporting surface about the axis during use by a sitter who is sitting on the seating surface.

68. The apparatus of claim 67 in which, when the seat is not occupied, the back supporting surface is biased to rise to a rest position vertically and to rotate to an upright resting orientation.

69. The seat of claim 1 comprising a mechanism that has a manual control that enables a user to selectively reduce the ability of the seating surface to move relative to the base forward and backward at two or more locations along the motion of the seating surface, the same manual control also enabling the user to control a height of the seat above the floor.

70. The apparatus of claim 69 in which the manual control comprises a lever that is reachable at a periphery and below the seat.

71. The apparatus of claim 69 in which the manual control can be moved in one direction to control the height of the seating surface through a gas cylinder and in a second direction to selectively reduce the ability of the seating surface to move relative to the base.

72. The apparatus of claim 1 comprising the back-supporting surface having a center of gravity above the axis of rotation, a rotation control mechanism that reduces the tendency of the back supporting surface to rotate back beyond a predetermined angle of rotation.

73. The apparatus of claim 72 in which the rotation control mechanism comprises a detent.

74. The apparatus of claim 72 also comprising a mechanism that stops the rotation of the back supporting surface at the upright position when it tends to rotate to the upright position.

75. The apparatus of claim 72 in which the back supporting surface is mounted so that its center of gravity is forward of the axis of rotation so that when the seat is not occupied, the back supporting surface tends to be rotated by the force of gravity to an upright position.

76. The apparatus of claim 75 in which the rotation control mechanism comprises a detent.

77. The apparatus of claim 1 in which the motion of the seating surface relative to the base toward and away from a vertical plane that contains the axis is along a direction of motion.

78. The apparatus of claim 77 in which the direction of motion is not an arc.

79. The apparatus of claim 78 in which the direction of motion comprises a line.

80. The apparatus of claim 77 in which the direction of motion comprises an arc.

81. The apparatus of claim 77 in which the direction of motion does not comprise a line.

82. The apparatus of claim 1 in which a path along which a portion of the back-supporting surface moves comprises an arc.

83. The apparatus of claim 1 in which the axis-transferring mechanism is configured so that the first element of the axis-transferring mechanism moves with and transfers the axis.

84. The apparatus of claim 1 in which the axis-transferring mechanism is configured so that the first element of the axis-transferring mechanism transfers the axis during at least a part of operation of the axis-transferring mechanism.

85. The apparatus of claim 1 in which the first element and the second element of the rotational mechanism define two substructures of the seat, one of the substructures including the back-supporting surface and the first element of the rotational mechanism, the other of the substructures including the elements of the axis-transferring mechanism.

86. The apparatus of claim 1 in which the back-supporting surface is connected to the first element of the rotational mechanism, the second element of the rotational mechanism is connected to the first element of the axis-transferring mechanism, and the second element of the axis-transferring mechanism is coupled to the base.

87. The apparatus of claim 1 in which a path along which a portion of the back-supporting surface moves does not comprise an arc.

88. The apparatus of claim 1 in which in which a path along which a portion of the back-supporting surface moves comprises a line.

89. The apparatus of claim 1 in which a path along which a portion of the back-supporting surface moves does not comprise a line.

90. A method of supporting a user above a floor, the method comprising:

rotating a back-supporting surface and a first element of a rotational mechanism about an axis that is higher from the floor than is a seating surface, in response to motion of a person sitting on the seating surface;

moving a seating surface toward and away from a vertical plane that contains the axis;

transferring the axis toward the floor in response to a force applied by the back of the person sitting on the seating surface and away from the floor in response to a lesser amount of force applied by the back of the person sitting on the seating surface, by moving (a) a first element of an axis-transferring mechanism that is coupled to a second element of the rotational mechanism, relative to (b) a second element of the transferring mechanism that is coupled to a base, the first and second elements of the axis-transferring mechanism having at least one mode of operation in which they are movable relative to one another separately from the rotation of the back-supporting surface and the first element of the rotational mechanism relative to the second element of the rotational mechanism, the first element and the second element of the axis-transferring mechanism being coupled together between the second element of the rotational mechanism and the base.

91. The method of claim 90, wherein rotating the back-supporting surface is based at least in part on a force exerted by a back of a user seated on the seating surface as the seating surface moves relative to the base toward and away from a vertical plane that contains the axis.

92. The method of claim 90, wherein rotating the back-supporting surface is based at least in part on a force exerted by a back of a user seated on the seating surface when the seating surface is not gliding.

93. The method of claim 90, wherein rotating the back-supporting surface comprises changing the included angle between the seating surface and the back-supporting surface.

94. The method of claim 93, wherein changing the included angle between the seating surface and the back-supporting surface comprises rotating the back-supporting surface about an axis parallel to the back-supporting surface and parallel to the seating surface.

95. The method of claim 93, wherein changing the included angle between the seating surface and the back-supporting surface comprises the seating surface moving relative to the base toward and away from a vertical plane that contains the axis.

96. The method of claim 90, wherein rotating the back-supporting surface comprises continuously varying an orientation of the back-supporting surface as the seating surface moves relative to the base toward and away from a vertical plane that contains the axis.

97. The method of claim 90, wherein rotating the back-supporting surface comprises changing a distance, parallel to the motion of the seating surface toward and away from the vertical plane, between the seating surface and the portion of the back-supporting surface closest to the seating surface.

98. An apparatus comprising:

a seating surface, a back-supporting surface;

a rotational mechanism to enable the back-supporting surface to rotate about an axis that is higher than is the seating surface, the rotational mechanism comprising a first element and a second element, the back-supporting surface and the first element being coupled for rotation about the axis relative to the second element in response to motion of a person sitting on the seating surface, the seating surface being movable toward and away from a vertical plane that contains the axis, and an axis-transferring mechanism to enable motion of the axis toward and away from the floor, the axis-transferring mechanism comprising a first element and a second element movable relative to one another, the first element of the axis-transferring mechanism being coupled to the second element of the rotational mechanism, and the second element of the axis-transferring mechanism being coupled to the base, the axis being transferable, by operation of the axis-transferring mechanism, toward the floor in response to a force applied by the back of a person sitting on the seating surface and away from the floor in response to a lesser amount of force applied by the back of the person sitting on the seating surface, the axis-transferring mechanism being configured so that the first element of the axis-transferring mechanism moves with and transfers the axis, the first and second elements of the axis-transferring mechanism having at least one mode of operation in which they are movable relative to one another separately from the rotation of the back-supporting surface and the first element of the rotational mechanism relative to the second element of the rotational mechanism.

99. An apparatus comprising:

a seating surface, a back-supporting surface, a rotational mechanism to enable the back-supporting surface to rotate about an axis that is higher from the floor than is the seating surface, the rotational mechanism comprising a first element and a second element, the back-supporting surface and the first element being coupled for rotation about the axis relative to the second element in response to motion of a person sitting on the seating surface, the seating surface being movable relative to a base toward and away from a vertical plane that contains the axis, and an axis-transferring mechanism to enable motion of the axis toward and away from the floor, the axis-transferring mechanism comprising a first element and a second element movable relative to one another, the first element of the axis-transferring mechanism being coupled to the second element of the rotational mechanism, and the second element of the axis-transferring mechanism being coupled to the base, the axis being transferable, by operation of the axis-transferring mechanism, toward the floor in response to a force applied by the back of a person sitting on the seat seating surface and away from the floor in response to a lesser amount of force applied by the back of the person sitting on the seating surface, the axis-transferring mechanism being configured so that the first element of the axis-transferring mechanism transfers the axis during at least a part of the operation of the axis-transferring mechanism, the first and second elements of the axis-transferring mechanism having at least one mode of operation in which they are movable relative to one another separately from the rotation of the back-supporting surface and the first element of the rotational mechanism relative to the second element of the rotational mechanism.

100. An apparatus comprising:

a seating surface, a back-supporting surface, a rotational mechanism to enable the back-supporting surface to rotate about an axis that is higher from the floor than is the seating surface, the rotational mechanism comprising a first element and a second element, the back-supporting surface and the first element being coupled for rotation about the axis relative to the second element in response to motion of a person sitting on the seating surface, the seating surface being movable relative to a base toward and away from a vertical plane that contains the axis, and an axis-transferring mechanism to enable motion of the axis toward and away from the floor, the axis-transferring mechanism comprising a first element and a second element movable relative to one another, the first element of the axis-transferring mechanism being coupled to the second element of the rotational mechanism, and the second element of the axis-transferring mechanism being coupled to the base, the axis being transferable, by operation of the axis-transferring mechanism, toward the floor in response to a force applied by the back of a person sitting on the seat seating surface and away from the floor in response to a lesser amount of force applied by the back of the person sitting on the seating surface, the first and second elements of the axis-transferring mechanism having at least one mode of operation in which they are movable relative to one another separately from the rotation of the back-supporting surface and the first element of the rotational mechanism relative to the second element of the rotational mechanism, the first element and the second element of the rotational mechanism defining two substructures of the seat, one of the substructures including the back-supporting surface and the first element of the rotational mechanism, the other of the substructures including the elements of the axis-transferring mechanism.

* * * * *

UNITED STATES PATENT AND TRADEMARK OFFICE

CERTIFICATE OF CORRECTION

PATENT NO. : 9,131,775 B1
APPLICATION NO. : 14/088599
DATED : September 15, 2015
INVENTOR(S) : Joel H. Eisenberg It is certified that error appears in the above-identified patent and that said Letters Patent is hereby corrected as shown below:

In the Claims
Col. 20, line 58, claim 88, delete "in which in which" and insert -- in which --

Signed and Sealed this
Fifth Day of July, 2016

Michelle K. Lee

Michelle K. Lee
*Director of the United States Patent and Trademark Office*